US007527254B2

(12) United States Patent
Tamura et al.

(10) Patent No.: US 7,527,254 B2
(45) Date of Patent: May 5, 2009

(54) SHEET FINISHER WITH A PUNCHING UNIT

(75) Inventors: Masahiro Tamura, Kanagawa (JP); Akihito Andoh, Kanagawa (JP); Junichi Iida, Kanagawa (JP); Shuuya Nagasako, Tokyo (JP); Hiroki Okada, Kanagawa (JP); Hiromoto Saitoh, Kanagawa (JP); Nobuyoshi Suzuki, Tokyo (JP); Kenji Yamada, Tokyo (JP); Junichi Tokita, Kanagawa (JP); Naohiro Kikkawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/239,326

(22) Filed: Sep. 30, 2005

(65) Prior Publication Data

US 2006/0022394 A1 Feb. 2, 2006

Related U.S. Application Data

(63) Continuation of application No. 10/385,489, filed on Mar. 12, 2003, now abandoned.

(30) Foreign Application Priority Data

| | | |
|---|---|---|
| Mar. 12, 2002 | (JP) | 2002-066421 |
| Mar. 25, 2002 | (JP) | 2002-082433 |
| Jun. 3, 2002 | (JP) | 2002-162121 |
| Jun. 3, 2002 | (JP) | 2002-162131 |
| Sep. 20, 2002 | (JP) | 2002-274815 |

(51) Int. Cl.
*B26D 7/00* (2006.01)
*B65H 37/04* (2006.01)

(52) U.S. Cl. ..... 270/58.07

(58) Field of Classification Search ..... 83/167; 270/58.07; 399/407, 403, 404, 405, 408; 198/359, 569; 227/27
See application file for complete search history.

(56) References Cited

U.S. PATENT DOCUMENTS

| | | | | |
|---|---|---|---|---|
| 4,181,171 | A | 1/1980 | Yonemitsu | |
| 4,809,576 | A * | 3/1989 | Bakermans et al. | 83/155 |
| 4,988,030 | A | 1/1991 | Muramatu et al. | |
| 5,253,030 | A * | 10/1993 | Shigemura et al. | 399/407 |
| 5,290,020 | A | 3/1994 | Matsui et al. | |

(Continued)

FOREIGN PATENT DOCUMENTS

| | | |
|---|---|---|
| JP | 61-94180 | 5/1986 |

(Continued)

OTHER PUBLICATIONS

"Power in Motion" Apr. 2007 article.*

(Continued)

*Primary Examiner*—Gene Crawford
*Assistant Examiner*—Leslie A Nicholson, III
(74) *Attorney, Agent, or Firm*—Oblon, Spivak, McClelland, Maier & Neustadt, P.C.

(57) ABSTRACT

A sheet finisher of the present invention includes a punching unit configured to punch a sheet handed over from an image forming apparatus to the sheet finisher. A scrap conveying unit conveys scraps produced from the sheet punched by the punching unit. A hopper stores scraps conveyed thereto by there scrap conveying unit. The hopper is mounted on the front side of the sheet finisher.

10 Claims, 35 Drawing Sheets

U.S. PATENT DOCUMENTS

| | | | | |
|---|---|---|---|---|
| 5,509,645 | A | 4/1996 | Shinno et al. | |
| 5,746,162 | A | 5/1998 | Hosoi et al. | |
| 5,793,298 | A | 8/1998 | Matsuura | |
| 6,014,920 | A | 1/2000 | Yamauchi et al. | |
| 6,120,015 | A | 9/2000 | Albright et al. | |
| 6,253,057 | B1 | 6/2001 | Yamanaka | |
| 6,325,585 | B1 | 12/2001 | Sasaki et al. | |
| 6,337,970 | B1 | 1/2002 | Okamoto et al. | |
| 6,381,443 | B1 * | 4/2002 | Kawata et al. | 399/407 |
| 6,813,472 | B2 | 11/2004 | Aizawa | |
| 2006/0022394 | A1 | 2/2006 | Tamura et al. | |

FOREIGN PATENT DOCUMENTS

| | | |
|---|---|---|
| JP | 01-146696 | 6/1989 |
| JP | 03 270 896 | 12/1991 |
| JP | 06 155 393 | 6/1994 |
| JP | 7-112861 | 5/1995 |
| JP | 7-314393 | 12/1995 |
| JP | 10-139264 | 5/1998 |
| JP | 10-310317 | 11/1998 |
| JP | 11 263 526 | 9/1999 |
| JP | 2000-254894 | 9/2000 |
| JP | 2000-334696 | 12/2000 |
| JP | 2001-25995 | 1/2001 |
| JP | 2003-182868 | 7/2003 |

OTHER PUBLICATIONS

U.S. Appl. No. 11/519,039, filed Sep. 12, 2006, Yamada et al.
U.S. Appl. No. 11/594,084, filed Nov. 8, 2006, Tamura et al.
U.S. Appl. No. 12/186,563, filed Aug. 6, 2008, Kikkawa et al.

* cited by examiner

SHEET FINISHER WITH A PUNCHING UNIT

CROSS-REFERENCES TO RELATED APPLICATIONS

This application is a continuation of and claims the benefit of priority from U.S. patent application Ser. No. 10/385,489 filed on Mar. 12, 2003, which claims the benefit of priority from Japanese Patent Application No. 2002-066421, filed on Mar. 12, 2002, from Japanese Patent Application No. 2002-082433, filed on Mar. 25, 2002, from Japanese Patent Application No. 2002-162121, filed on Jun. 3, 2002, from Japanese Patent Application No. 2002-162131, filed on Jun. 3, 2002, and from Japanese Patent Application No. 2002-274815, filed on Sep. 20, 2002, the entire contents of all of which are incorporated herein by reference.

BACKGROUND OF THE INVENTION

1. Field of the Invention

The present invention relates to a sheet finisher including a punching unit and more particularly to an image forming system in which the sheet finisher is constructed integrally with or separately from an image forming apparatus.

2. Description of the Background Art

Today, a copier, printer or similar image forming apparatus with a sheet finisher including a punching unit is extensively used. Japanese Patent Laid-Open Publication No. 2001-25995, for example, discloses an image forming apparatus including a punch and a die for punching a sheet, scrap conveying means for conveying the resulting scraps, and a scrap box for storing the scraps. The scrap conveying means is implemented as a screw type conveyor while the scrap box is removably mounted to the outside of the apparatus body. When the scrap box is dismounted from the apparatus body, the scrap conveying means stops being driven, but the apparatus continues its image forming operation. This, according to the above document, not only prevents the scraps from being scattered around the apparatus body, but enhances productivity as to image formation.

However, the problem with the image forming apparatus described above is that the scrap box is mounted on the rear of the apparatus body, as seen from the operation side. The scrap box is therefore difficult to handle although image formation may be continued after the removal of the scrap box.

Japanese Patent Laid-Open Publication No. 7-112861, for example, teaches an image forming apparatus including a container or storing means for storing scraps produced from punched sheets. The container is mounted to or dismounted from the apparatus body via an opening formed in the side wall of the apparatus body. Further, the container is formed of transparent plastics or similar material so as to allow the container to be seen from the outside. The above document additionally proposes an arrangement in which the container is mounted to one side of the apparatus body, so that scraps stored in the container can be dealt with at the outside of the apparatus body. However, the container mounted on the side of the apparatus body needs an exclusive space for the replacement of the container beside the apparatus body. Further, because the container cannot be extended deep into the apparatus body, punching must be performed in the vicinity of the side wall of the apparatus body. It is therefore necessary to limit the direction of sheet conveyance in accordance with the punching position.

Further, Japanese Patent Laid-Open Publication No. 6-155393, for example, proposes an image forming apparatus including a punching mechanism mounted on an openable cover forming part of one side of the apparatus body. Scraps produced by the punching mechanism are stored in a tank removably mounted to the apparatus body. The openable cover, however, needs an exclusive space beside the apparatus body, so that the cover can be opened. It follows that a space broad enough for the tank to be removed is required beside the apparatus body, increasing the overall space to be occupied by the apparatus.

The conventional image forming apparatuses of the type including a sheet finisher with a punching unit have other problems left unsolved, as enumerated below.

(1) When scraps produced from a sheet by the punching unit drop, they should be surely received by a belt including in a scrap conveying unit. To meet this requirement, the belt must be provided with a length great enough to convey the scraps over a distance between, among a plurality of holes, holes at opposite ends, i.e., 80 mm in Japan or 240 mm in Europe. Also, the belt must be positioned beneath the plurality of holes. Further, it is likely that the scraps fail to fully part from the belt due to static electricity.

(2) The scrap box mounted on the rear of the apparatus body is not only difficult to handle, but also problematic when it is dismounted because image formation is continued, i.e., scraps are continuously produced.

(3) To solve the above problem (2), the scrap box or scrap storing means may be mounted on the front of the sheet finisher. This, however, gives rise to another problem that when the scraps conveyed by the scrap conveying means toward the scrap box have fibers appearing on their edges, they are caught by adjoining members and cannot be smoothly or surely introduced into the scrap box.

Technologies relating to the present invention are also disclosed in, e.g., Japanese Patent Laid-Open Publication Nos. 6-155393, 2000-334696 and 2001-2-5995.

SUMMARY OF THE INVENTION

It is an object of the present invention to provide a small size, space saving sheet finisher easy to handle and allowing scraps to be dealt with only at the operation side, and an image forming system using the same.

It is another object of the present invention to provide a sheet finisher capable of surely introducing scraps in scrap storing means and efficiently using a space, and an image forming system using the same.

It is another object of the present invention to provide a sheet finisher capable of introducing scraps in scrap storing means without causing them to drop to the outside or being scattered around, and an image forming system using the same.

It is another object of the present invention to provide a sheet finisher capable of causing scraps to drop into scrap storing means in the form of a pile as flat as possible, and an image forming system using the same.

It is another object of the present invention to provide a sheet finisher capable of forcibly removing scraps from scrap conveying means before the scraps again enter the sheet finisher via a front side wall, and an image forming system using the same.

It is another object of the present invention to provide a sheet finisher capable of surely conveying scraps with a belt, and an image forming system using the same.

It is another object of the present invention to provide a sheet finisher capable of removing scraps from a stripe-like conveying surface at an adequate position and introducing them in a hopper, and an image forming system using the same.

It is still another object of the present invention to provide a sheet finisher not needing an exclusive motor for scrap conveying means, and an image forming system using the same.

It is yet another object of the present invention to provide a sheet finisher capable of surely conveying scraps without regard to whether or not image formation is under way, and an image forming system using the same.

It is a further object of the present invention to provide a sheet finisher capable of surely introducing even scraps with fibers appearing on their edges into scrap storing means, and an image forming system using the same.

A sheet finisher of the present invention includes a punching unit configured to punch a sheet handed over from an image forming apparatus to the sheet finisher. A scrap conveying unit conveys scraps produced from the sheet punched by the punching unit. A hopper stores scraps conveyed thereto by there scrap conveying unit. The hopper is mounted on the front side of the sheet finisher.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the image forming system in accordance with the present invention will be described hereinafter.

First Embodiment

Figure 1:
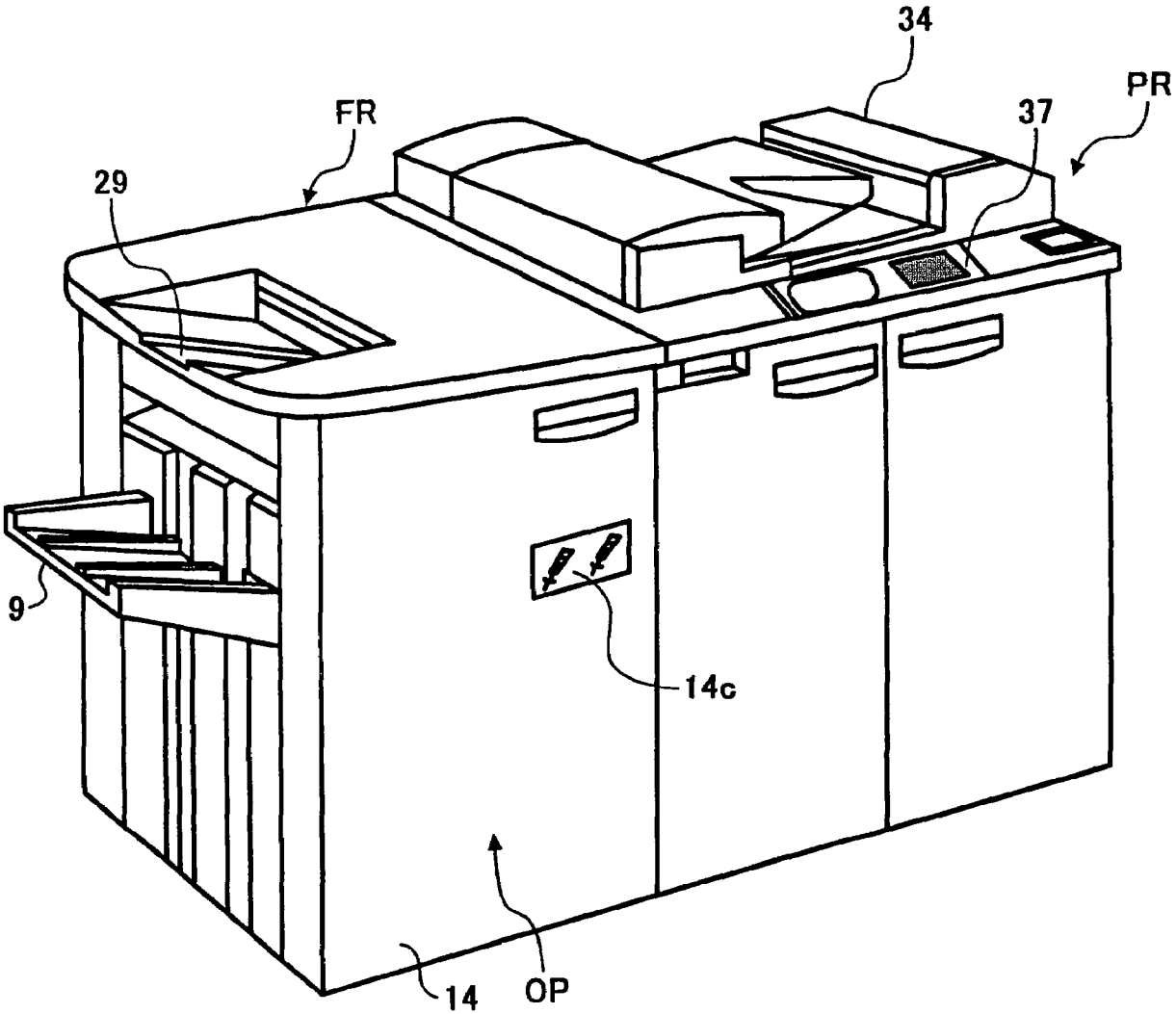
FIG. 1 is an isometric view showing a first embodiment of the image forming system in accordance with the present invention and made up of an image forming apparatus and a sheet finisher.
Figure 2:
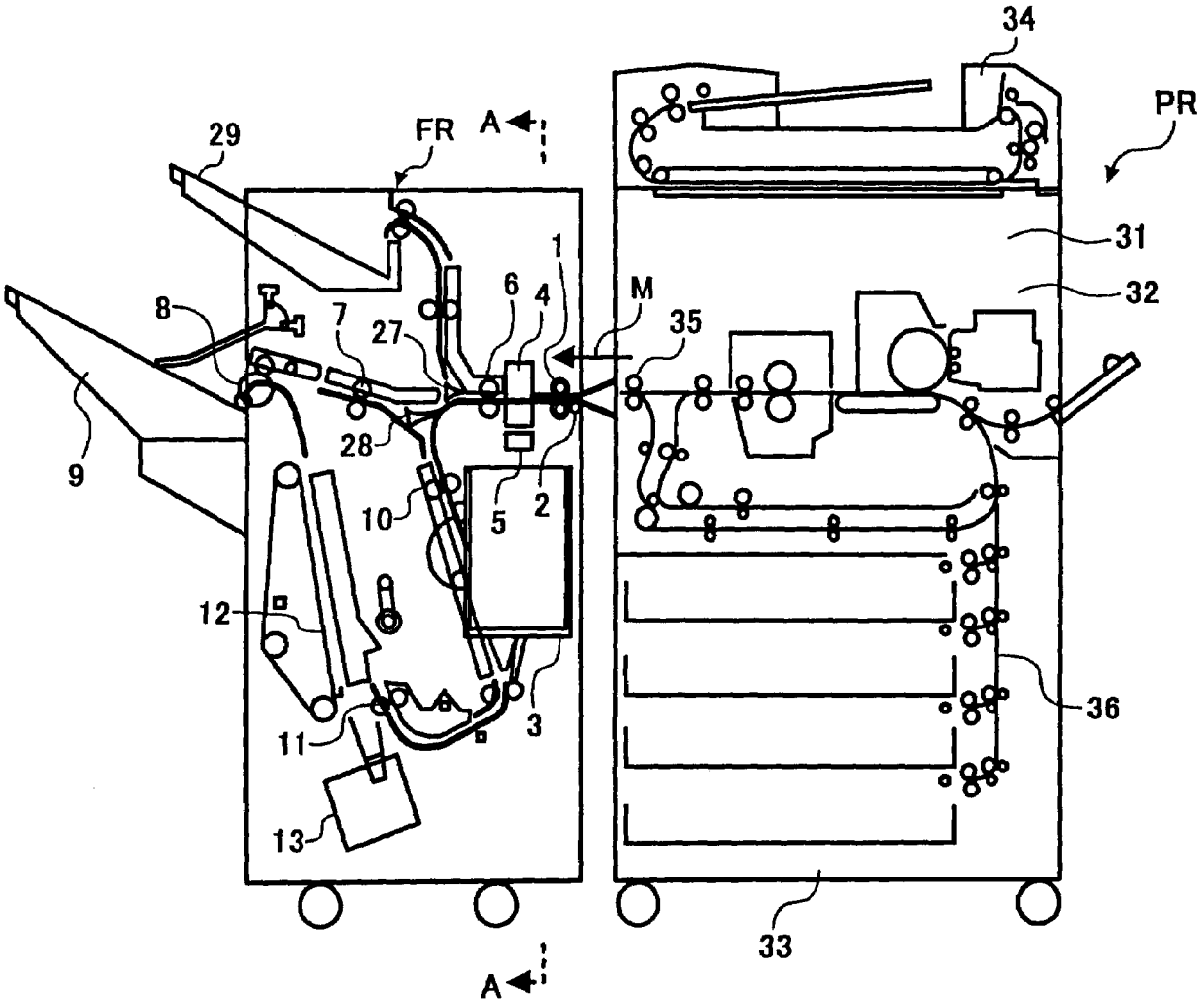
FIG. 2 is a view showing arrangements inside the image forming system of FIG. 1.

Referring to FIGS. 1 and 2, an image forming system embodying the present invention is shown and made up of an image forming apparatus PR and a finisher FR. As shown, the image forming apparatus PR, which has a copying function, includes a document scanning section 31, an image writing section 32, a sheet feeding section 33, and a document conveying section 34.

The document scanning section 31 is configured to scan a document with a scanner in the main scanning direction while moving the scanner in the subscanning direction. The document feeding section (ADF (Automatic Document Feeder) hereinafter) 34 feeds the document to a glass platen.

The image writing section 32 is implemented as conventional optics including a laser diode, a polygonal mirror, and an fθ lens. The optics optically scans the surface of a photoconductive element for thereby forming a latent image. The latent image is then developed by toner. The resulting toner image is transferred from the photoconductive element to a sheet or recording medium and then fixed by a fixing unit. Subsequently, the sheet with the fixed toner image is handed over from the image forming apparatus PR to the sheet finisher FR.

In the illustrative embodiment, the sheet feeding section 33 has four sheet feeding stages stacked one above another. A vertical sheet path 36 extends from the pay-out side or right side, as viewed in FIG. 2, of the sheet feeding stages to the image writing section 32.

Figure 3:
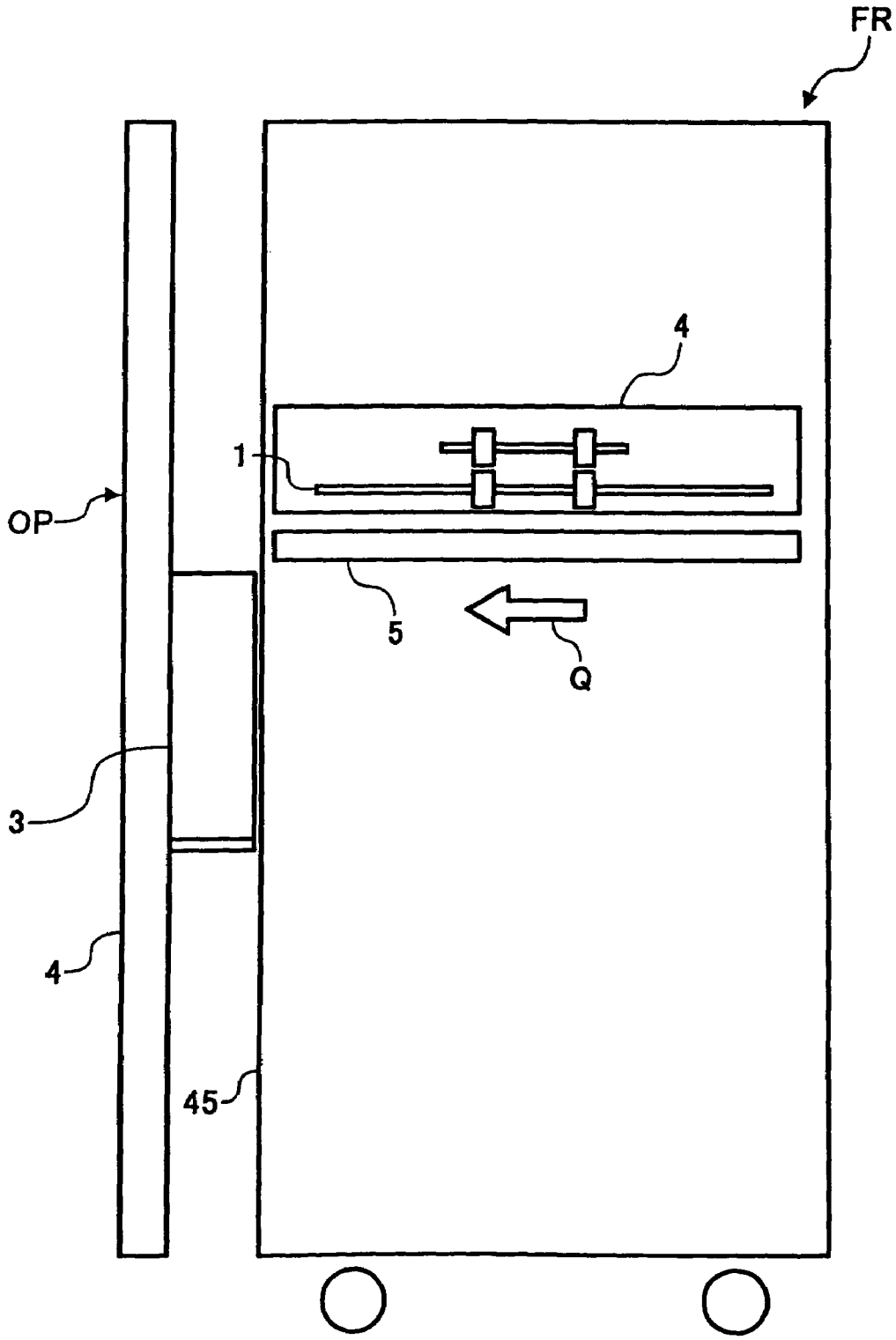
FIG. 3 is a section along line A-A of FIG. 2.

The sheet carrying the toner image thereon and driven out of the image forming apparatus PR is introduced into the sheet finisher FR in a direction indicated by an arrow M. The sheet finisher FR includes a punching unit 4 for punching the sheet introduced into the sheet finisher FR. The punching unit or punching means 4 is positioned downstream of an inlet roller pair 1 in the direction of sheet conveyance, but upstream of a roller pair 6. A scrap conveying unit or conveying means 5 is positioned beneath the punching unit 4 for conveying scraps produced from punched sheets. More specifically, as shown in FIG. 3 which is a section along line A-A of FIG. 2, the scrap conveying unit 5 extends in the direction perpendicular to the direction of sheet conveyance and conveys scraps 23 (see FIG. 4) in a direction Q. The direction Q is toward an operation side OP where the operator stands to input desired information meant for the sheet finisher FR or the image forming apparatus PR on an operation panel 37 or to replace toner or remove a jamming sheet.

More specifically, the operator replaces toner or removes a jamming sheet by opening a front cover 14 forming part of a housing on the operation side OP. A hopper or scrap storing means 3 is mounted on the inside of the front cover 14, so that the scraps are conveyed to the hopper 3 in the direction Q. The scrap conveying unit 5 and hopper 3 assigned to the scraps will be described more specifically later. The front cover 14 may be provided with a transparent window 14*c*, so that the operator can see the inside of the hopper 3. In the illustrative embodiment, the window 14*c* is so positioned as to allow the operator to see the top opening of the hopper 3. The window 14*c* is implemented by a sheet of glass or transparent resin (see FIGS. 5 and 6).

The sheet P punched by the punching unit 4 is steered by path selectors 27 and 28 to be stacked on a shift tray 9 by way of, e.g., a stapling station. Alternatively, the sheet P may be simply driven out to a proof tray 29.

More specifically, in a sort mode, the path selector 27 is so positioned as to steer the sheet P to a path on which a roller pair 7 is located. The sheet P is then driven out to the shift tray 9 via the roller pair 7 and an outlet roller pair 8. The tray 9 is shifted in the direction perpendicular to the direction of sheet conveyance copy by copy, thereby sorting the consecutive sheets P on a copy basis.

In a staple mode, the path selector 27 is so positioned as to steer the sheet P to a path on which a roller pair 10 is located. The sheet P is then conveyed to a staple tray 12 by the roller pair 10 and a roller pair 11. Every time one sheet P is brought to the staple tray 12, a knock roller knocks it downward toward a rear fence. After a preselected number of sheets P constituting a single copy have been stacked on the staple tray 12, a stapler 13 staples one end, trailing edge in the illustrative embodiment, of the sheet stack. Subsequently, a belt conveys the stapled sheet stack upward toward the outlet roller pair 8. As a result, the stapled sheet stack is also driven out to the shift tray 9.

As stated above, the punching unit 4 and hopper 3 are positioned upstream of all of the other finishing stations in the direction of sheet conveyance and can therefore punch any kind of sheet.

The reference numerals 2 and 45 in FIGS. 2 and 3, respectively, designate an inlet sensor and a front side wall included in the apparatus body, respectively.

Figure 4:
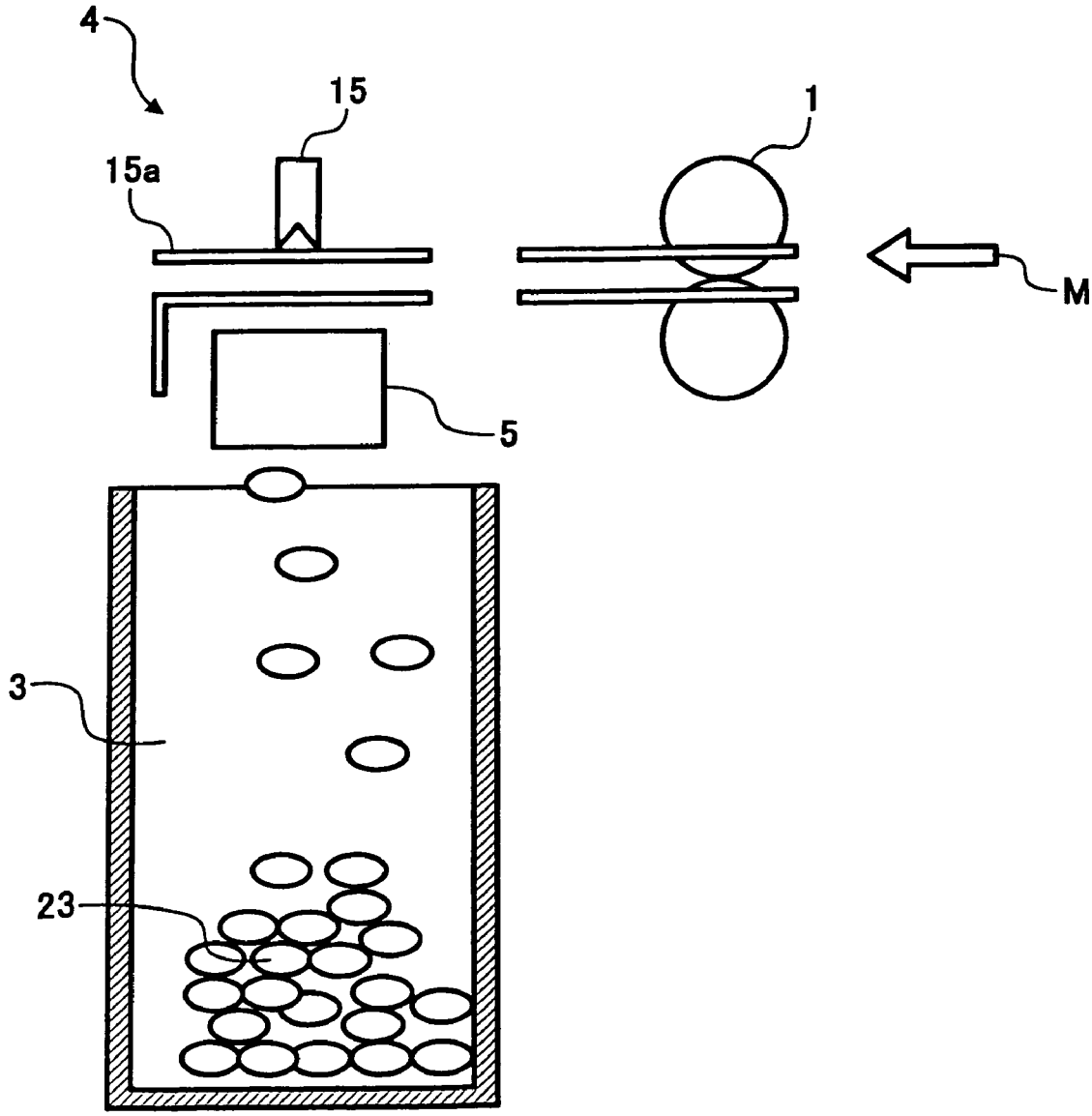
FIG. 4 is a view showing a punching unit and a hopper included in the illustrative embodiment in detail.

FIG. 4 shows the punching unit 4 and hopper 3 more specifically. As shown, the punching unit 4 includes a punch 15 movable to punch a sheet, which enters the punching unit 4 in a direction indicated by an arrow M. The punching unit 4 may use, e.g., a press punching system shown in FIGS. 10 and 11 or a rotary punching system shown in FIGS. 12 and 13. In the press punching system, after the sheet has been brought to a stop at a preselected position, the punch 15 is moved in the up-and-down direction to punch the sheet. In the rotary punching system, while the sheet is being conveyed, the punch 15 is rotated in synchronism with the movement of the sheet to thereby punch the sheet.

Figure 5:
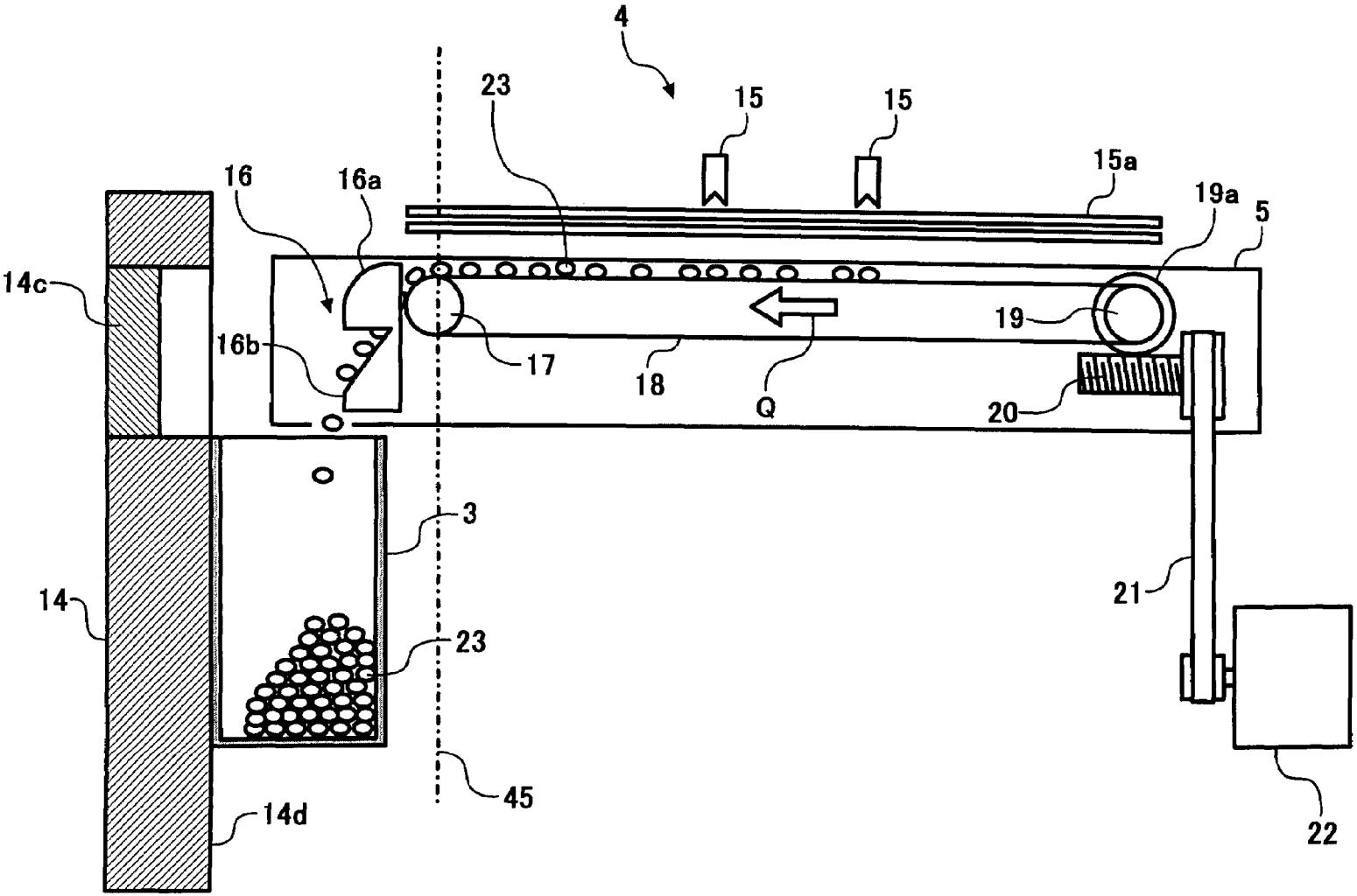
FIG. 5 shows a scrap conveying unit specifically and a positional relation between it, the punching unit and the hopper.

FIG. 5 shows a positional relation between the scrap conveying unit 5, the punching unit 4 and the hopper 3. As shown, the punching unit 4 includes two punches 15 arranged side by side in the direction Q. A sheet brought to the punches 15 while being guided by a sheet guide 15*a* is stopped there for a moment, and then the punches 15 are moved downward to punch the sheet. Scraps 23 produced from the sheet by the punches 15 drop on a belt 18 included in the scrap conveying unit 5 and positioned beneath the sheet guide 15*a*. The belt 18 is passed over a drive timing pulley 19 and a driven timing pulley 17 with preselected tension. The upper run of the belt 18 on which the scraps 23 drop moves in the direction Q to convey the scraps 23 toward the operation side OP, i.e., the front cover 14.

More specifically, a worm wheel 19*a* is formed integrally with the drive timing pulley 19 and held in mesh with a worm 20. The worm 20 in rotation causes the belt 18 to turn counterclockwise, as viewed in FIG. 5, via the worm wheel 19*a* and drive timing pulley 19, so that the belt 18 conveys the scraps 23 in the direction Q. A stepping motor 22 drives the worm 20 via a timing belt 21. The scraps 23 conveyed to the operation side OP by the belt 18 drop into the hopper 3 via a scrap guide 16. The hopper 3 is removably mounted to the inside of the front cover 14.

The scrap guide 16 includes a tubular guide 16*a* whose inner periphery has an arcuate section and a slope guide 16*b* inclined toward the inlet of the hopper 3. The upper end of the slope guide 16*b* adjoins part of the belt 18 passed over the driven timing pulley 17.

In the illustrative embodiment, the driven timing pulley 17 protrudes into a space between the front cover 14 and the front side wall 45 of the apparatus body, so that the scraps 23 are handed over from the belt 18 to the guide 16 in the above space. The hopper 3 is positioned below such a position. Therefore, the hopper 3, scrap guide 6 and at least part of the timing pulley 17 are positioned between the front cover 14 and the front side wall 45.

Figure 6:
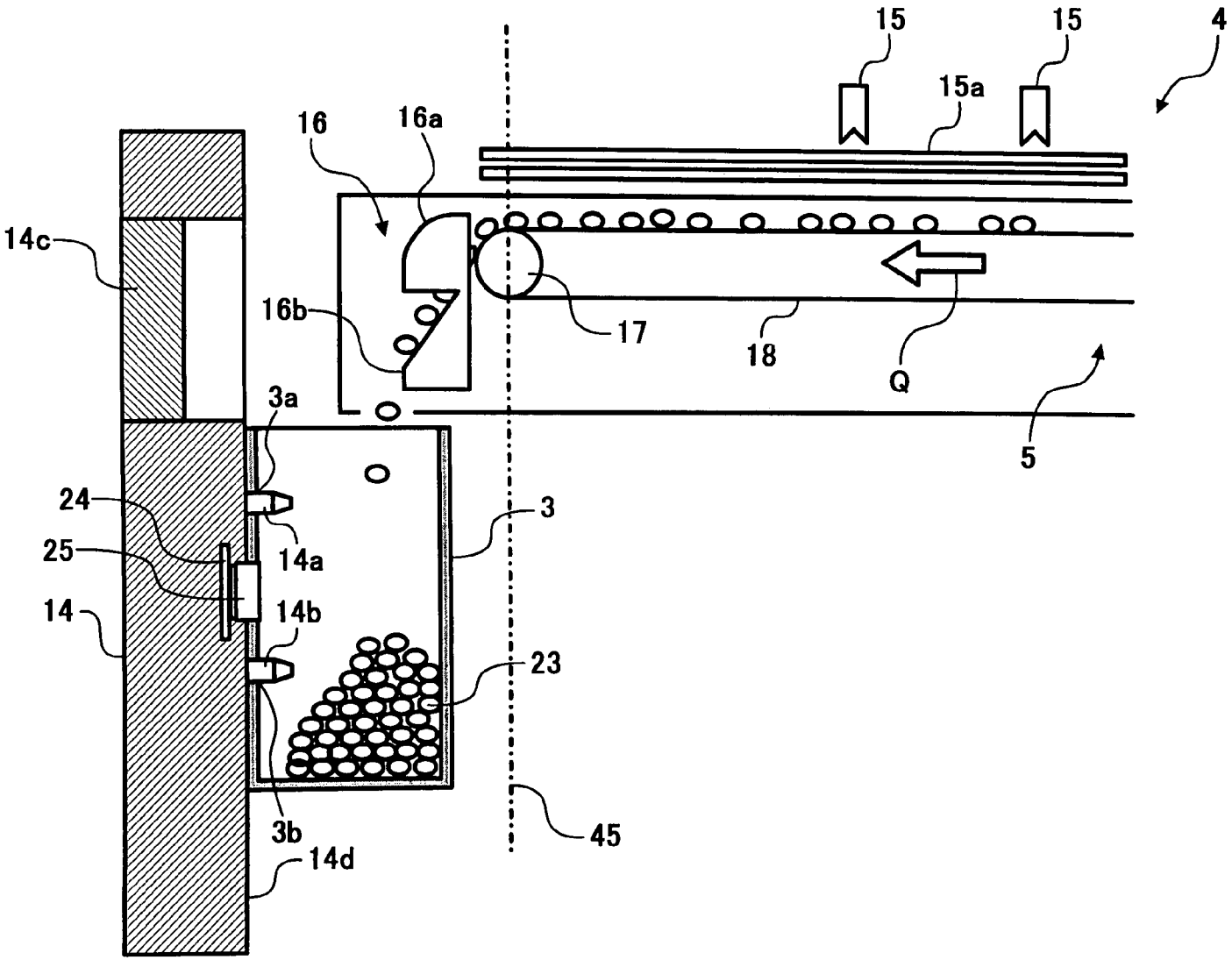
FIG. 6 shows a specific configuration of the hopper removably mounted to the inside of an operable front cover included in the sheet finisher.

FIG. 6 shows how the hopper 3 is removably mounted to the inside of the front cover 14 in detail. As shown, a magnet 25 is mounted on the hopper 3 and magnetically supported by a bracket 24, which is adhered to or buried in the inner surface 14*a* of the front cover. Positioning pins 14*a* and 14*b* are studded on the inner surface 14*d* of the front cover 14 while positioning holes 3*a* and 3*b* are formed in the hopper 3. The positioning pins 14*a* and 14*b* are respectively inserted in the positioning holes 3*a* and 3*b* for thereby positioning the hopper 3 relative to the front cover 14. In this sense, the positioning pins 14*a* and 14*b* play the role of a guide for guiding the hopper 3.

The magnetic force of the magnet 25 must be great enough to support the hopper 3 even when the hopper 3 is filled with the scraps 23. Such a magnetic force, however, is sufficient in consideration of easy mounting or dismounting of the hopper 3. It is noteworthy that the front cover 14 is opened and closed in the event of jam processing and toner replacement as well and causes the hopper 3 to vibrate. As a result, the pile of scraps 23 in the hopper 3 collapses and allows the hopper 3 to accommodate more scraps 23.

As shown in FIGS. 5 and 6, the transparent window 14*c* is mounted on the front cover 14 at such a position that the operator can see the top opening of the hopper 3 mounted on the inner surface of the front cover 14.

Figure 7:
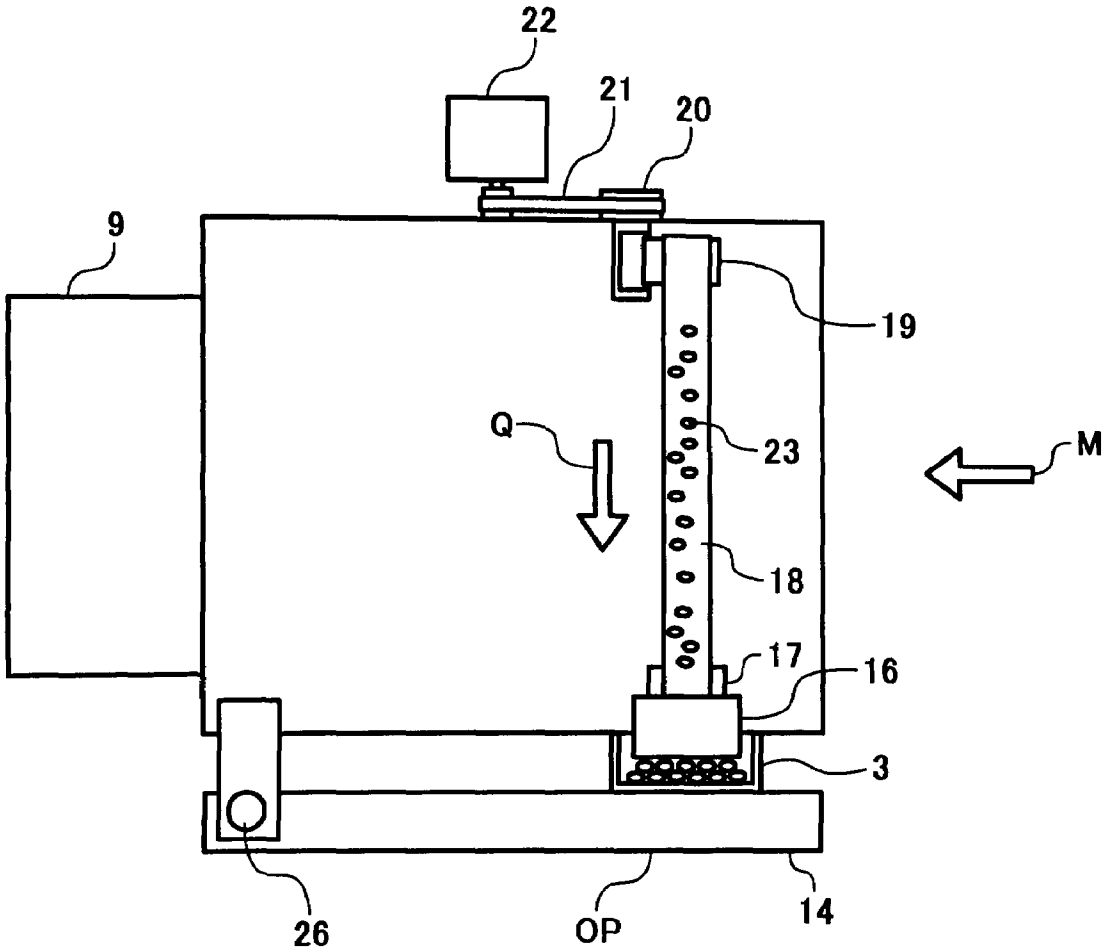
FIG. 7 is a plan view showing the scrap conveying unit in the usual operating condition in which the front cover is closed.
Figure 8:
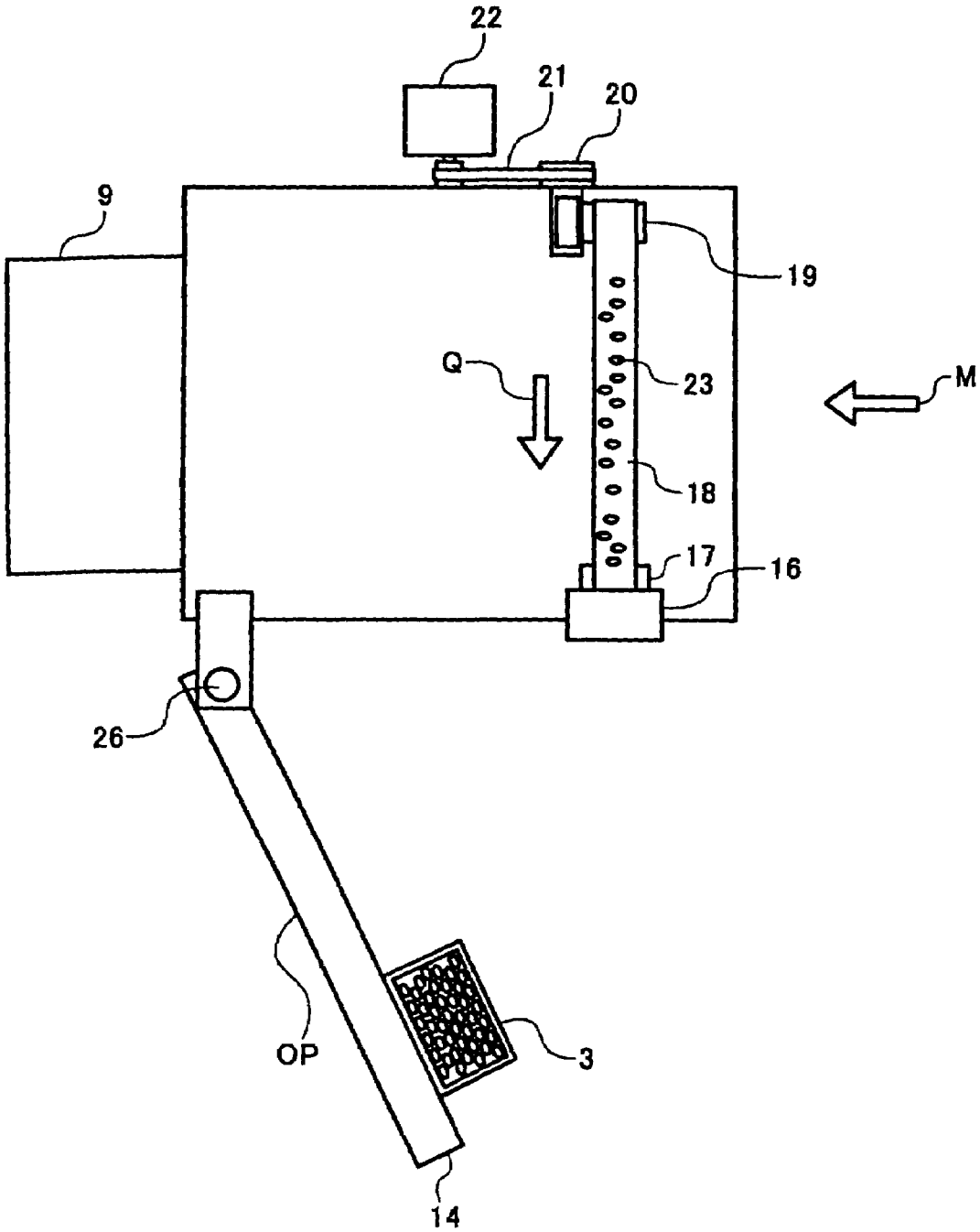
FIG. 8 is a view similar to FIG. 7, showing the front cover in an open position.

FIGS. 7 and 8 respectively show the scrap conveying mechanism in a condition wherein the front cover 14 is closed and a condition wherein it is opened. As shown in FIG. 8, the front cover 14 is hinged to the left side of the sheet finisher FR, as seen from the operation side OP, via a shaft 26. When the front cover 14 is opened, the hopper 3 mounted on the front cover 14, of course, moves together with the front cover 14.

As shown in FIG. 2, when the front cover 14 is in the closed position, the hopper 3 blocks the scrap conveying path. Should the hopper 3 be not retractable from the position shown in FIG. 2, then it would obstruct the operator intending to, e.g., open a guide plate for removing a jamming sheet. This is why the hopper 3 must be moved together with the front cover 14 when the front cover 14 is opened. Stated another way, the hopper 3 can be increased in size so long as it does not obstruct, e.g., jam processing when moved together with the front cover 14.

Figure 9:
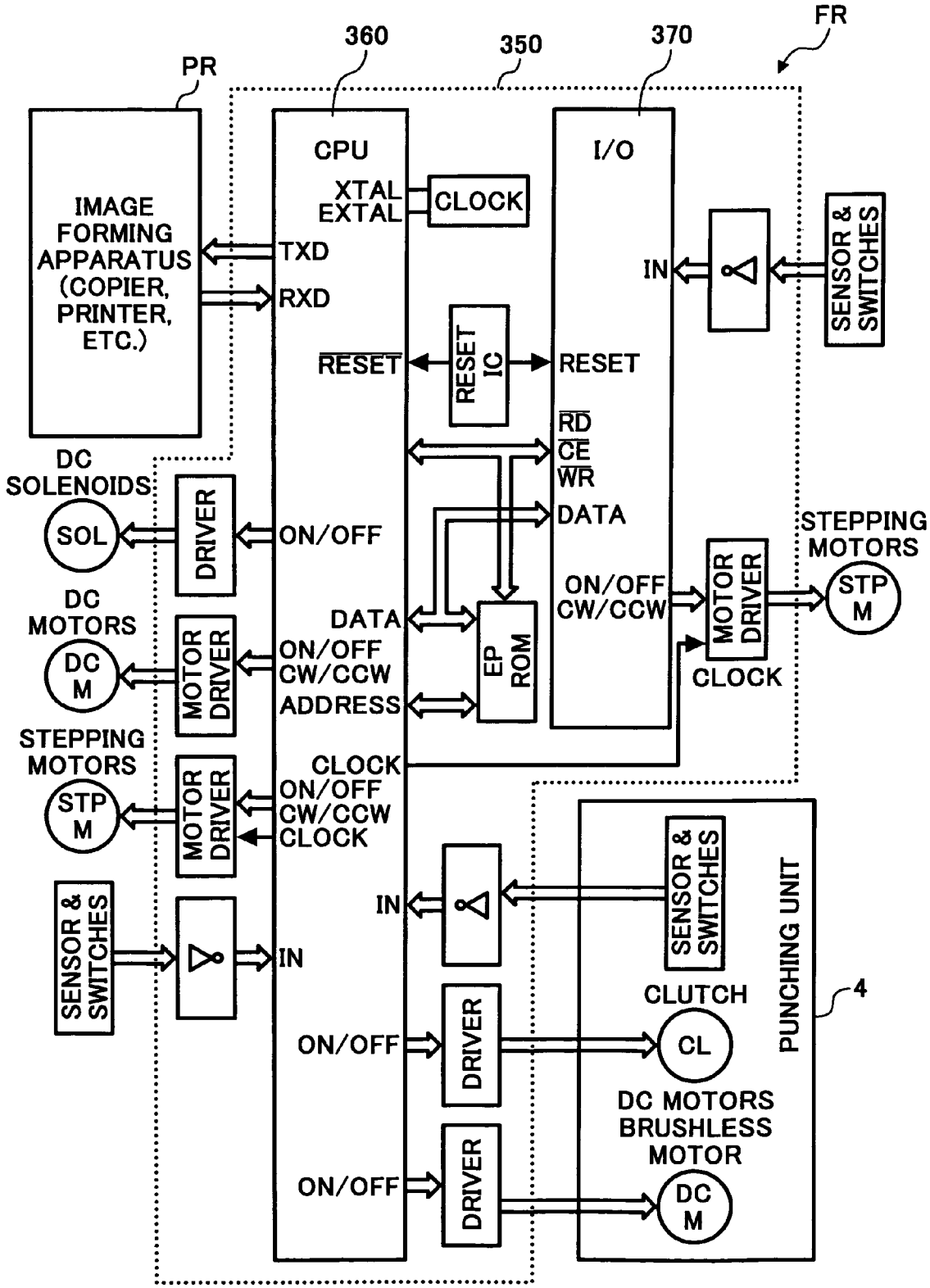
FIG. 9 is a schematic block diagram showing a control system included in the illustrative embodiment.

Reference will be made to FIG. 9 for describing a control system included in the illustrative embodiment. As shown, a controller or control unit 350 is implemented as a microcomputer including a CPU (Central Processing Unit) 360 and an I/O (Input/Output) interface 370. The CPU 360 receives the outputs of various switches arranged on the operation panel 37, FIG. 1, inlet sensor 2 as well as the outputs of a sensor responsive to the discharge of a sheet to the shift tray 9, a sensor responsive to the height of a sheet stack on the tray 9 and so forth via the I/O interface 370.

The CPU 360 controls the various operations of the sheet finisher FR in accordance with the above inputs: the up-down movement of the punches 15, operation of the scrap conveying unit 5, jogging operation effected on the staple tray 13 in the direction perpendicular to the direction of sheet conveyance, stapling by the stapling unit 13, discharge of a stapled sheet stack, movement of the shift tray 9, operation of the knock roller and so forth. Pulse signals input to a staple motor, not shown, that drives the roller pair 11 are counted by the CPU 360 and used to control the knock roller and jogging.

It is to be noted that the CPU 360 controls the sheet finisher FR in accordance with a program stored in a ROM (Read Only Memory), not shown, while using a RAM (Random Access Memory), not shown, as a work area.

Figures 10A, 10B, 10C, 10D, 10E:
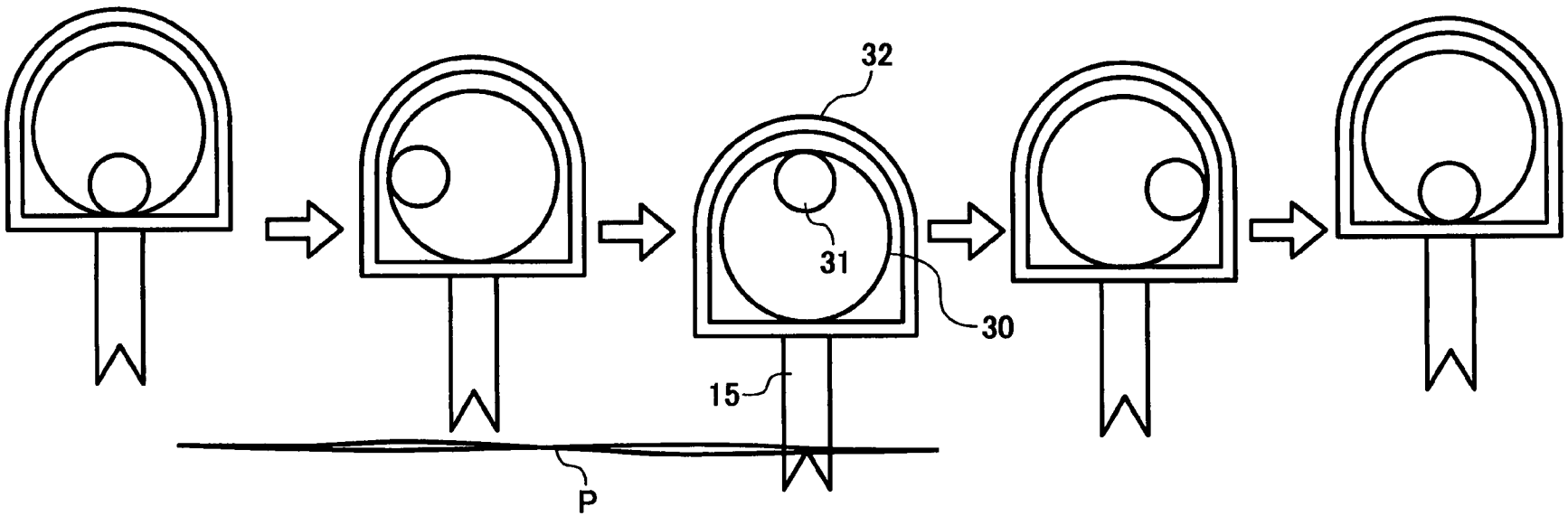
FIG. 10 demonstrates the operation the punching unit to which a press punching system is applied.
Figure 11:
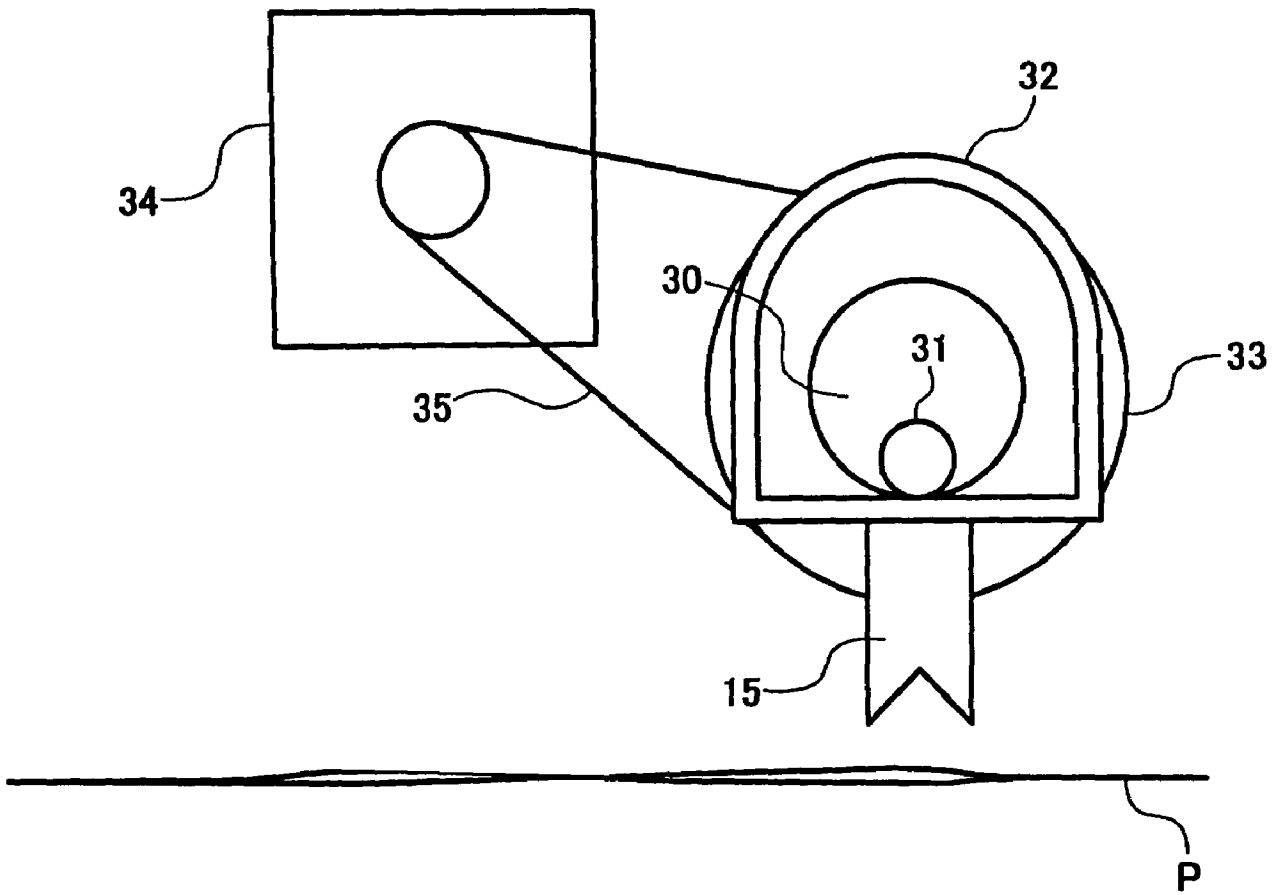
FIG. 11 shows a driveline included in a pressing mechanism for effecting the operation of FIG. 10.

Referring to FIGS. 10 and 11, the press punching system mentioned earlier and applied to the punching unit 4 will be described hereinafter. In FIG. 10, (a) and (b) show one of the punches 15 in the initial position and a position just after the start of downward movement, respectively. In FIG. 10, (c) shows the punch 15 in a position where it punched the sheet P. After the position (c), the punch 15 moves upward to the initial position shown in (e) via a position shown in (d).

FIG. 11 shows a drive mechanism assigned to the punch 15. As shown, a cam 30 is rotatable about a shaft 31 and causes the punch 15 to move vertically downward to punch the sheet P, as shown in FIG. 10, (c). More specifically, the punch 15 punches the sheet P brought to a stop in a preselected period of time or after a preselected number of pulses since the trailing edge of the sheet P has moved away from the inlet sensor, FIG. 2. More specifically, a holder 32 includes an inner surface contacting the circumference of the cam 30. The cam 30, rotating about the shaft 31, presses the above surface of the holder 32 downward, so that the holder 32 presses punch 15 engaged therewith downward toward the sheet P.

A stepping motor 34 drives a pulley 33 mounted on the shaft 31 via a timing belt 35. As for drive transmission from the pulley 33 to the shaft 31, an arrangement may be made such that the pulley 33 is constantly driven by the stepping motor 34 via the timing belt 35 while the rotation of the pulley 33 is transferred to the shaft 31 via a one-way clutch, not shown, as needed. Alternatively, the stepping motor 34 may be selectively driven to transfer its output torque to the shaft 31.

Figures 12A, 12B, 12C, 12D, 12E:
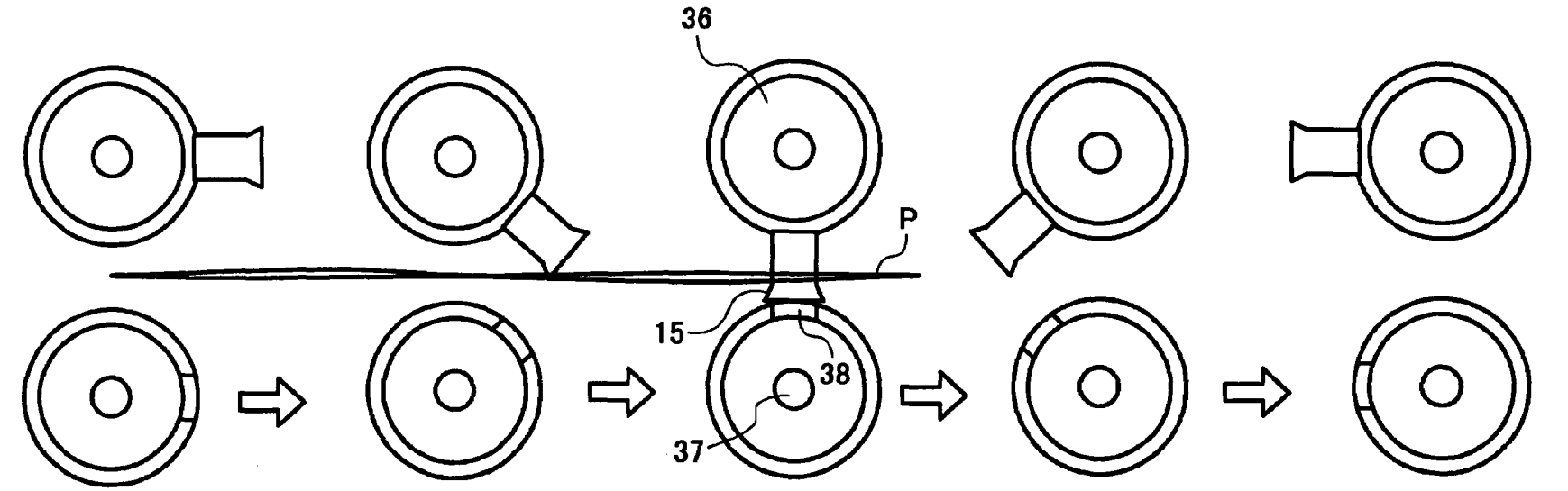
FIG. 12 demonstrates the operation of the punching unit to which a rotary punching system is applied.

FIG. 12 shows the rotary punching system also mentioned earlier and applied to the punching unit 4. In FIG. 12, (a) and (b) show one of the punches 15 in the initial position and a position just after the start of rotary movement, respectively. In FIG. 12, (c) shows the punch 15 in a position where it punched the sheet P. After the position (c), the punch 15 angularly moves to a position shown in (e) by 90° via a position shown in (d).

Figure 13:
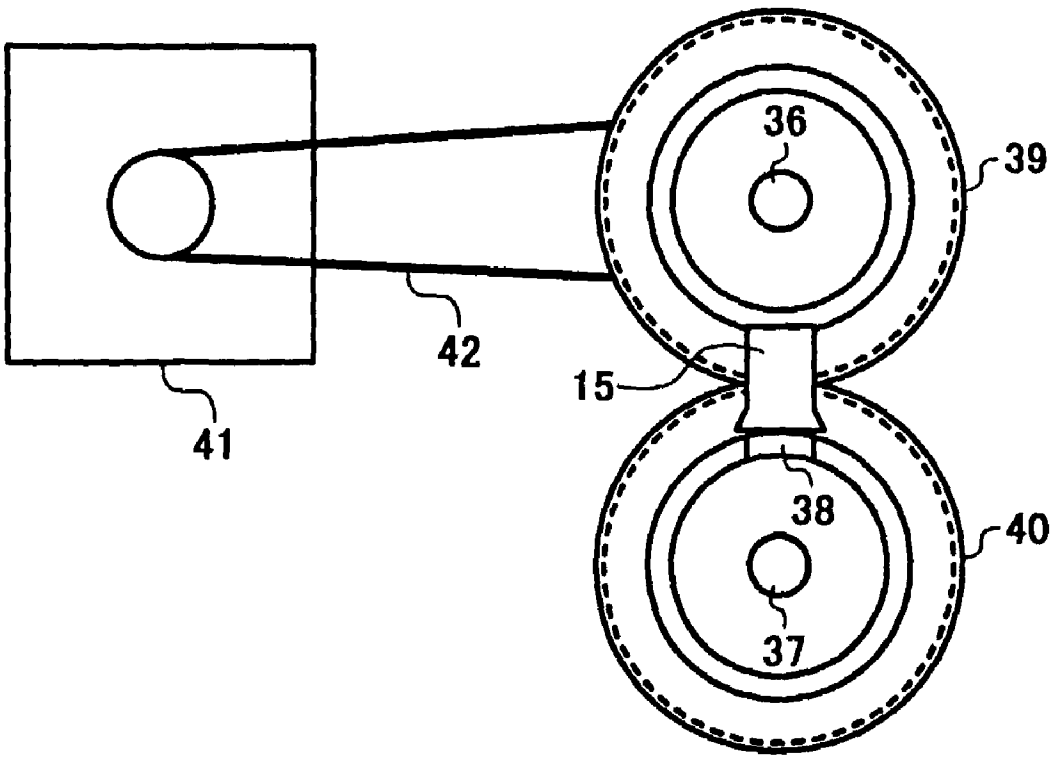
FIG. 13 shows a driveline included in a rotary mechanism for effecting the operation of FIG. 12.

FIG. 13 shows a drive mechanism included in the rotary punching system. As shown, the punch 15 is rotatable about a shaft 36. A die 38 is located at a position where it forms a pair with the punch 15, and is rotatable about a shaft 37. The punch 15 and die 378 start rotating when the sheet P is conveyed by a distance corresponding to a preselected number of pulses since the trailing edge of the sheet P has moved away from the inlet sensor 2, punching the sheet P in the position of FIG. 12, (c). More specifically, the punch 15 and die 38 each are mounted on one of a pair of rotary bodies facing each other via the sheet P and rotatable about the shafts 36 and 37, respectively. Gears 39 and 40 are mounted on the shafts 36 and 37, respectively, and held in mesh with each other. A stepping motor 41 drives the gear 39 via a timing belt 42.

The rotary punching system described above can punch successive sheets without stopping them and therefore makes it needless to care about the image forming speed. In addition, control is simplified because the sheet P does not have to be stopped.

Second Embodiment

This embodiment differs from the previous embodiment in that it additionally includes means for sensing the full state of the hopper 3 and means for determining whether or not the hopper 3 is mounted at a preselected position. As for the rest of the construction, the illustrative embodiment is identical with the previous embodiment, so that identical structural elements are designated by identical reference numerals and will not be described specifically.

Figure 14:
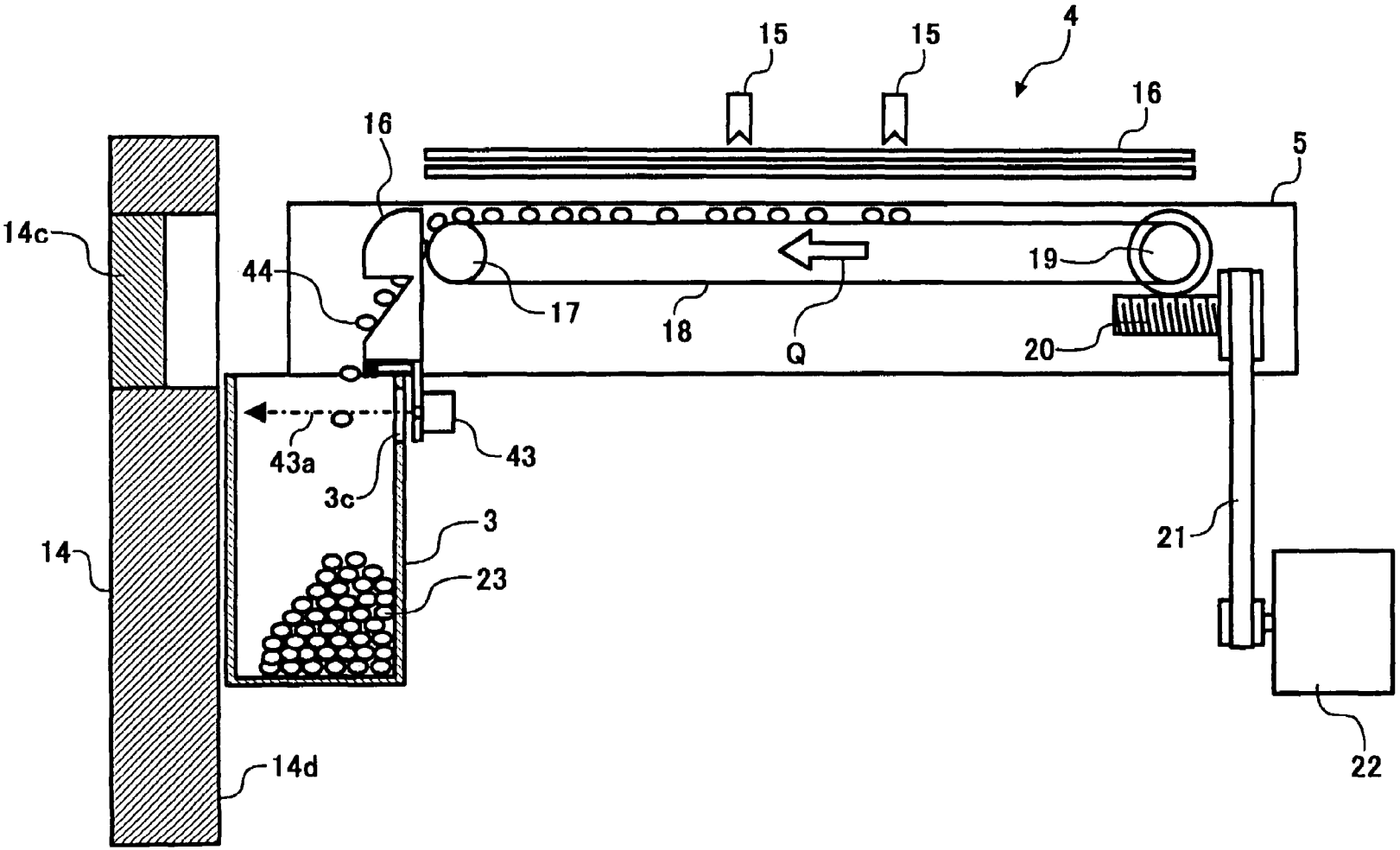
FIG. 14 shows a mechanism for determining whether or not the hopper is present and whether or not it is filled up with scraps and representative of a second embodiment of the present invention.
Figure 15:
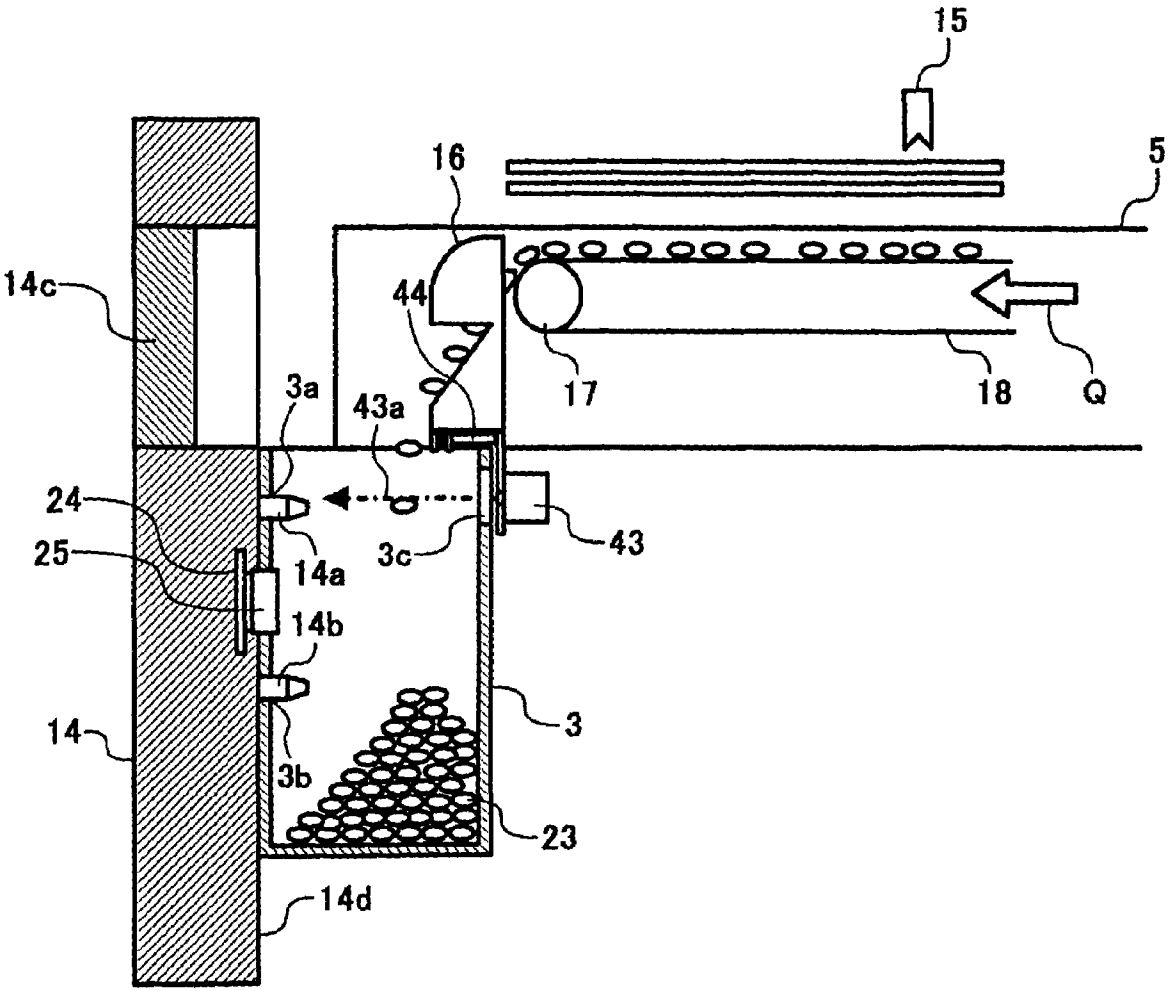
FIG. 15 shows the sensing mechanism of FIG. 14 together with a mechanism for mounting and dismounting the hopper.

As shown in FIGS. 14 and 15, the second embodiment includes a single photosensor 43 bifunctioning as a full sensor responsive to the full state of the hopper 3 and a hopper sensor responsive to the hopper 3 at the same time. The sensor or sensing means 43 is located at a position where the bottom of the scrap guide 16 faces the hopper 3. As shown in FIG. 14, an opening 3*c* is formed in the hopper 3 in alignment with the sensor 43.

Figure 16:
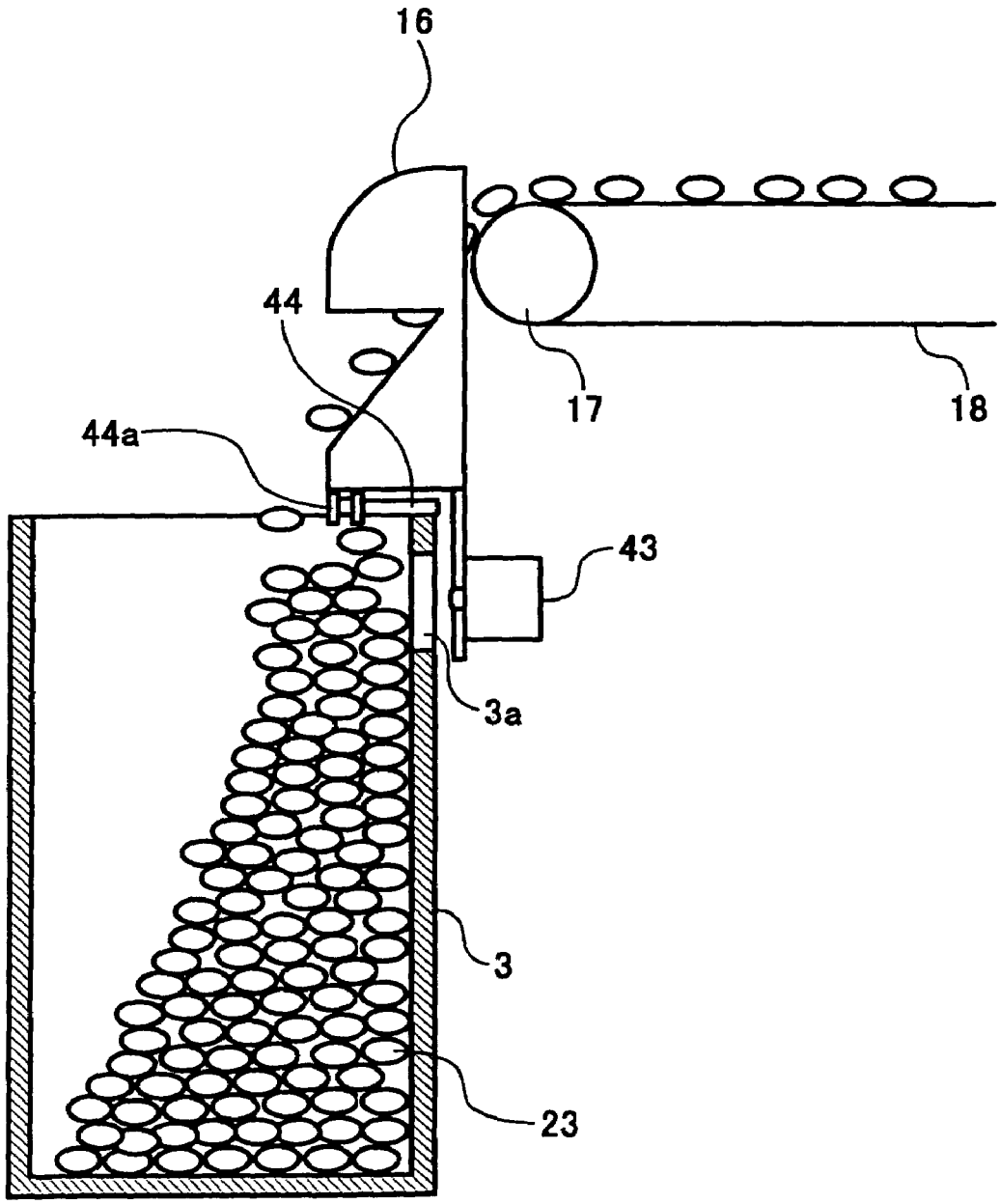
FIG. 16 shows a specific condition wherein the hopper is filled up with scraps, and a sensor plays the role of a full sensor.

FIG. 16 shows a specific condition wherein the hopper 3 is filled up with the scraps 23. In this condition, the sensor 43 senses the full state of the hopper 3 because the pile of scraps 23 blocks the optical path of the sensor 43. At this instant, a shutter 44 is pushed upward by the hopper 3 and angularly moved about a fulcrums 44*a*, which is present on the scrap guide 16, to remain in an almost horizontal position. The sensor 43 therefore does not sense the shutter 44.

Figure 17:
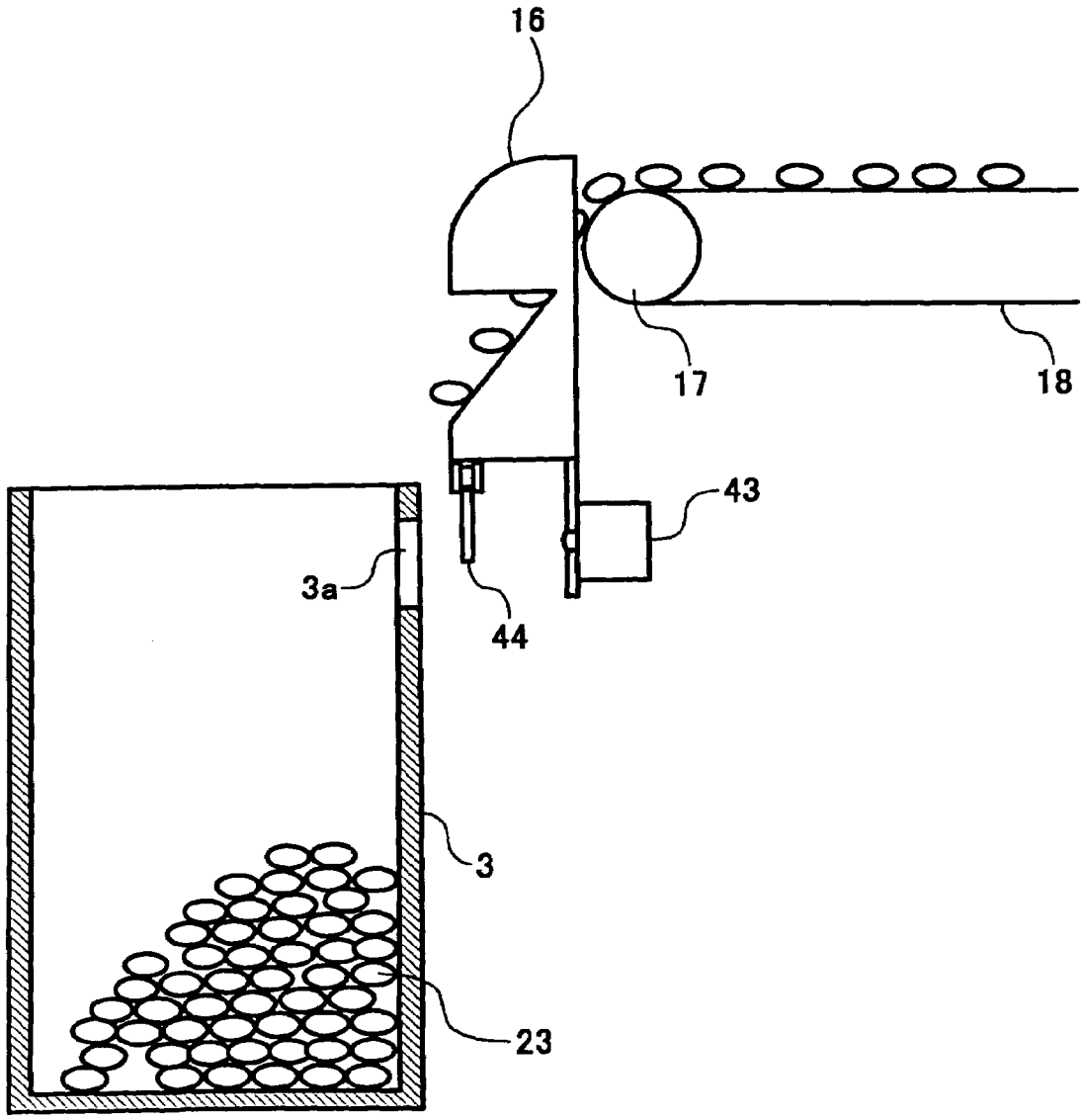
FIG. 17 shows a relation between the hopper, a shutter and the sensor when the sensor plays the role of a hopper sensor.

FIG. 17 shows the hopper 3 dismounted away from the shutter 44 or moved together with the front cover 14 toward the open position. As shown, the shutter 44 is angularly moved clockwise from the position of FIG. 16 about the fulcrum 44*a* and hangs down. In this case, the sensor 43 senses the shutter 44 present on the optical path of the sensor 43 and therefore indicates that the hopper 3 is dismounted. In this sense, the sensor 43 plays the role of the two means mentioned earlier at the same time. Because the sensor 43 and hopper 3 are fully separated from each other, the hopper 3 can be easily emptied.

In the illustrative embodiment, when the output of the sensor 43 indicates the full state of the hopper 3 or the absence of the hopper 3, image forming operation is inhibited in order to prevent the scraps 23 from dropping to the floor. More specifically, the CPU 360 inhibits image forming operation when the hopper 3 is unable to be used, as sensed by the sensor 43. For this purpose, the output of the sensor 43 is also sent to the CPU 360 via the I/O interface 370.

The sensor 43 is implemented as a reflection type sensor or photoreflector. Therefore, when the sensor 43 senses reflection, the shutter 44 is held in the lowered position of FIG. 17 or the hopper 3 is filled up with the scraps 23. On the other hand, a sensor, not shown, responsive to the opening/closing of the front cover 14 exists. When this sensor senses the shutter 44 hanging down when the front cover 14 is closed, the CPU 360 determines that the hopper 3 is not mounted on the front cover 14. If desired, whether or not the hopper 3 is present on the front cover 14 and whether or not the hopper 3 is full may be determined independently of each other on the basis of a difference in level between the output derived from the shutter 44 and the output derived from the pile of scraps 23.

The sensor 43 and shutter 44 both are mounted on the scrap guide 16 while the scrap guide 16 is constructed as part of the scrap conveying unit 5. It is therefore possible to assemble the entire scrap conveying unit 5 as a unit in a factory and then put it on the market as a unit.

Third Embodiment

Figure 18:
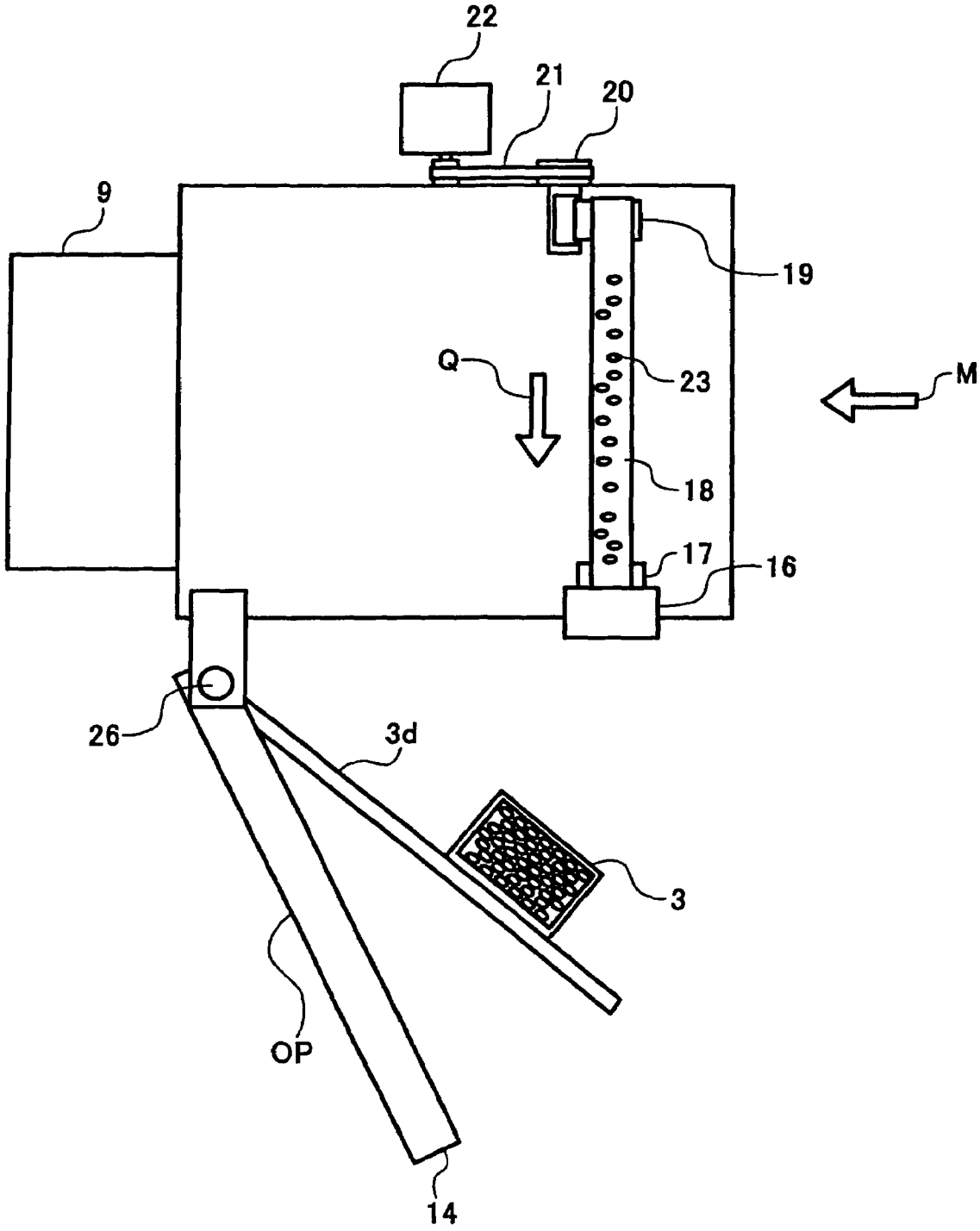
FIG. 18 is a fragmentary view showing a front cover representative of a third embodiment of the present invention and held in an open position.

In the embodiments shown and described, the hopper 3 is magnetically supported on the inner surface of the front cover 14 and moved together with the front cover 14. However, the crux is that the hopper 3 be positioned inside of the front cover 14. As shown in FIG. 18, in a third embodiment of the present invention, a stay 3*d* is hinged to the previously mentioned shaft 26 and supports the hopper 3 on its inner surface, so that the front cover 14 can be opened and closed independently of the hopper 3. The third embodiment therefore makes it needless to give consideration to the mechanical strength of the front cover 14, which is implemented as a resin molding. As for the rest of the configuration, the third embodiment is identical with the first and second embodiments.

As stated above, in the first to third embodiments, the scrap storing means is mounted on the front side of the sheet finisher, i.e., at the same side as the operation side of another apparatus that hands over a sheet to the sheet finisher or on an openable door parallel to the direction of sheet conveyance and capable of uncovering the inside of the sheet finisher. This realizes a small size, space saving sheet finisher easy to operate and allowing sheet scraps to be dealt with only at the operation side, and an image forming system using the same.

Fourth Embodiment

This embodiment is essentially similar to the first embodiment described with reference to FIGS. 1 through 13. The following description will concentrate on differences between the fourth embodiment and the first embodiment.

In the first embodiment, the belt 18 conveys the scraps 23 toward the front or operation side in the direction Q over the front side wall 45, as stated with reference to FIG. 5. The scraps 23 can therefore be surely dropped into the hopper 3 positioned between the front side wall 45 and the front cover 14. More specifically, the front end of the driven timing pulley 17 necessarily protrudes toward the front cover 14 over the front side wall 45, so that the scraps 23 are prevented from entering the inside of the sheet finisher when dropped from the belt 18.

Figure 19:
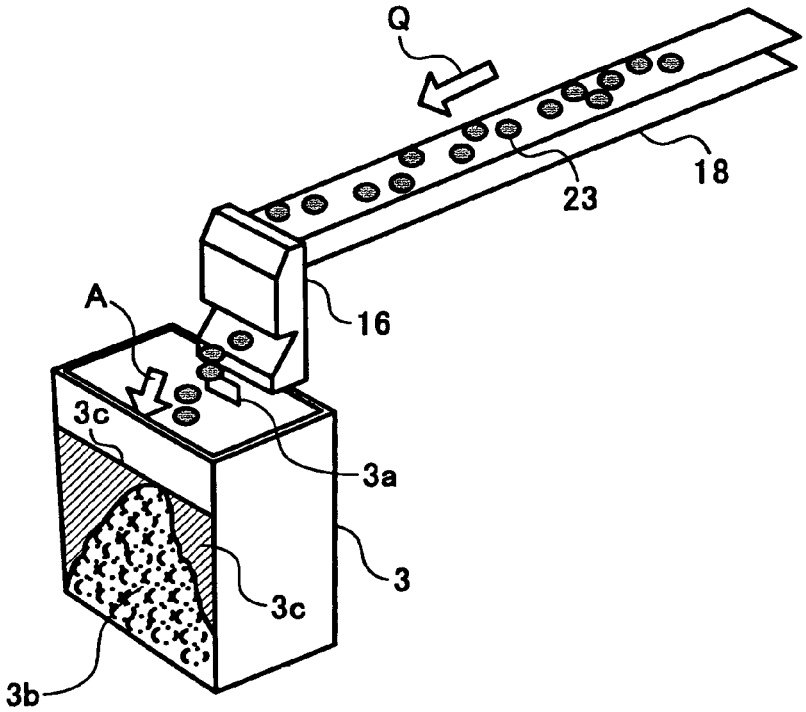
FIG. 19 is a perspective view showing a conventional condition wherein scraps are introduced into the hopper.

FIG. 19 demonstrates how the scraps 23 are stored in the hopper 3 in the first embodiment. As shown, the scraps 23 conveyed by the belt 18 in the direction Q drops in a direction A via the inclined surface of the scrap guide 16. While the scraps 23 dropped in the direction A pile up in the hopper 3, they drop substantially from the same portion of the scrap guide 16 because of the flat inclined surface and therefore form a pile with a single peak, as indicated by a line 3*b*. The pile 3*b* grows up to the window 3*a* of the hopper 3 with the result that the hopper 3 is determined to be full despite that it still has room to accommodate more scraps.

Figure 20:
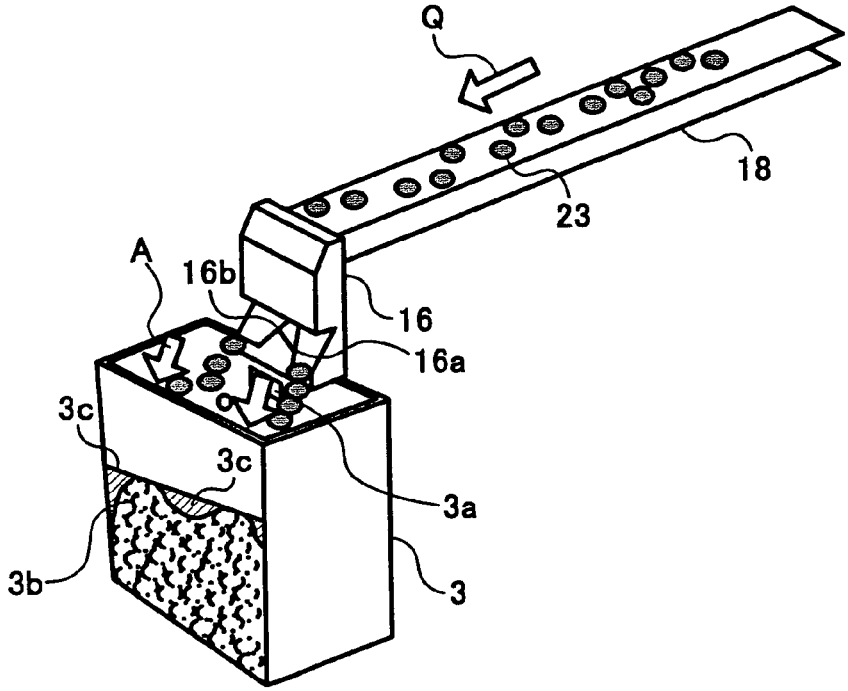
FIG. 20 is a view similar to FIG. 19, showing a condition wherein scraps are introduced into the hopper in a fourth embodiment of the present invention.

By contrast, as shown in FIG. 20, the illustrative embodiment configures the guide surface 16*a* of the guide 16 such that two inclined surfaces extend downward from a ridge 16*b*, so that the scraps 23 drop in the direction A along the two inclined surfaces. Consequently, the scraps 23 in the hopper 3 form a pile having two peaks, as indicated by a line 3*b* in FIG. 20. This successfully promotes the efficient use of the space available in the hopper 3 for a given number of sheets.

If desired, the guide surface 16*b* with a single ridge 16*b* may be replaced with a division plate or flap-like plate configured to divide the scraps 23 flowing along the inclined surface of the scrap guide 16.

Figure 21:
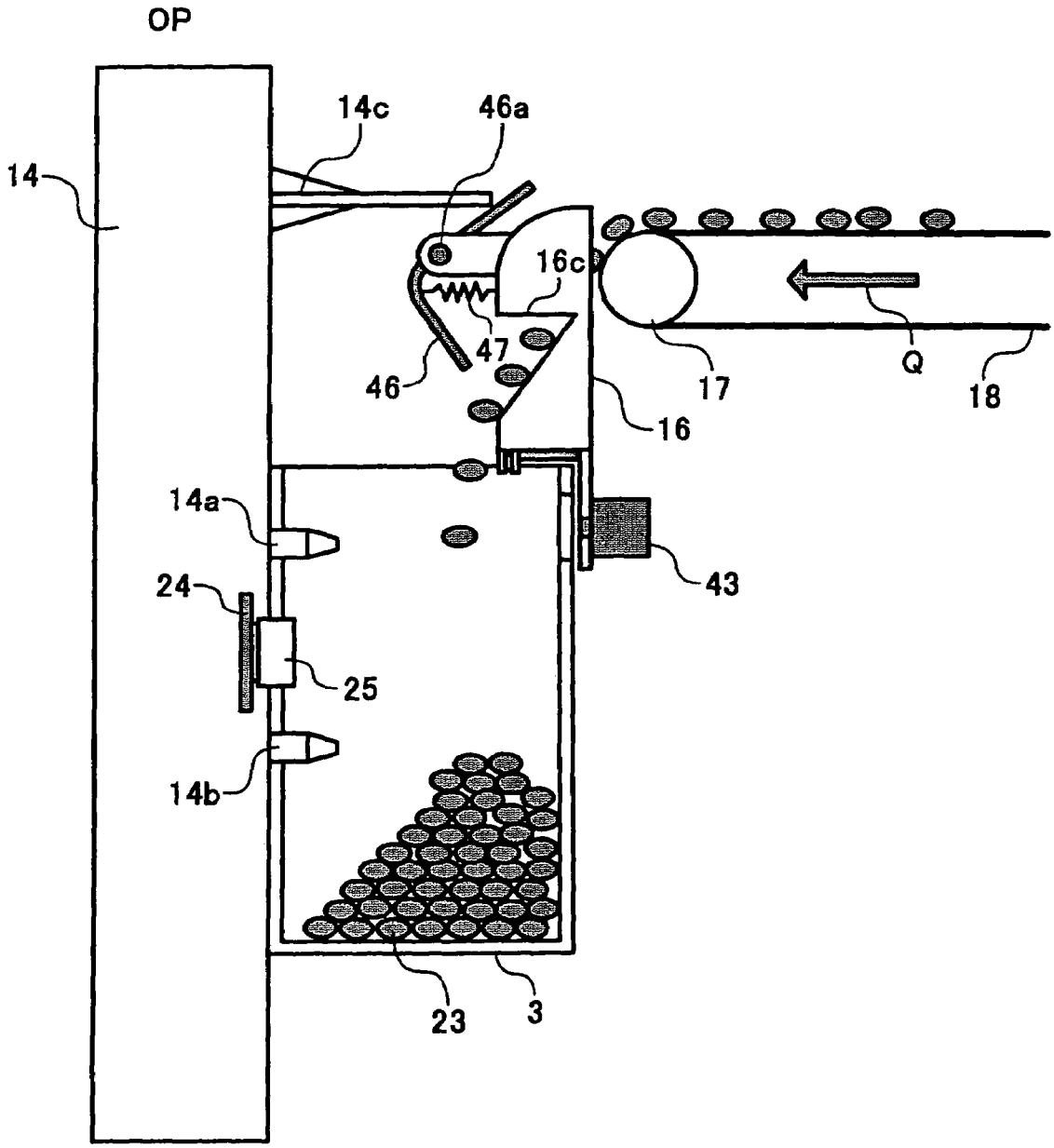
FIGS. 21 and 22 demonstrate the operation of a screen plate included in a scrap guide.
Figure 22:
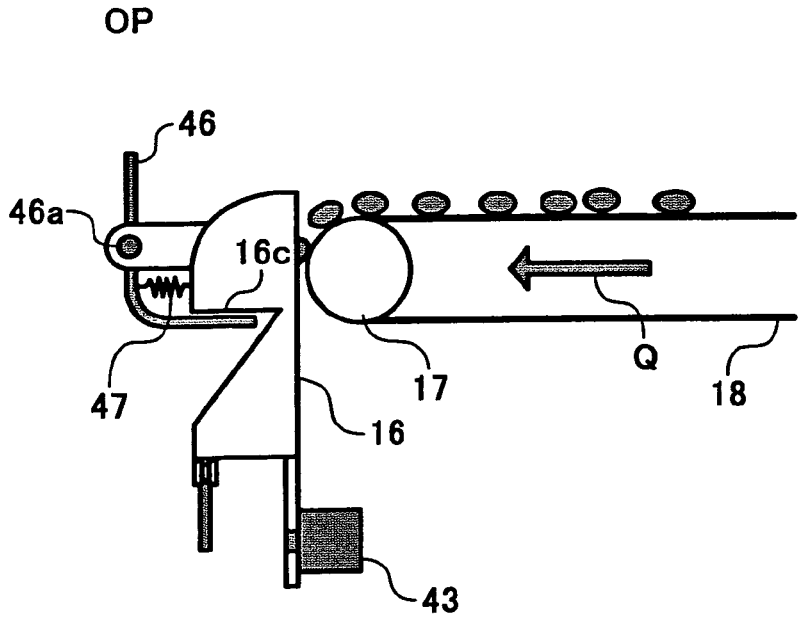

As shown in FIGS. 21 and 22, the scrap guide 16 of the illustrative embodiment includes a screen plate 46 having a generally L-shaped cross-section. The screen plate 46 is angularly movably supported by a shaft 46*a*. A spring 47 constantly biases the horizontal portion of the L-shaped screen plate 46 in a direction in which the screen plate 46 closes an outlet 16*c* formed in the scrap guide 16. Therefore, as shown in FIG. 22, the screen plate 46 initially closes the outlet 16*c* of the scrap guide 16, preventing the scraps 23 from dropping.

As shown in FIG. 21, a projection 14*c* protrudes from the inner surface of the front cover 14. When the front cover 14 is closed, the projection 14*c* pushes the upright portion of the screen plate 46 and causes it to angularly move about the shaft 46*a* clockwise, as viewed in FIG. 21, against the action of the spring 47, opening the outlet 16*c* of the scrap guide 16. In this condition, the scraps 23 can drop into the hopper 3 via the outlet 16*c*.

As stated above, the screen plate 46 unblocks the outlet 16*c* of the scrap guide 16 only when the front cover 14 is opened, allowing the scraps 23 to drop into the hopper 3. This prevents the scraps 23 from dropping via the scrap guide 16 during or after the opening of the front cover 14.

Figure 23:
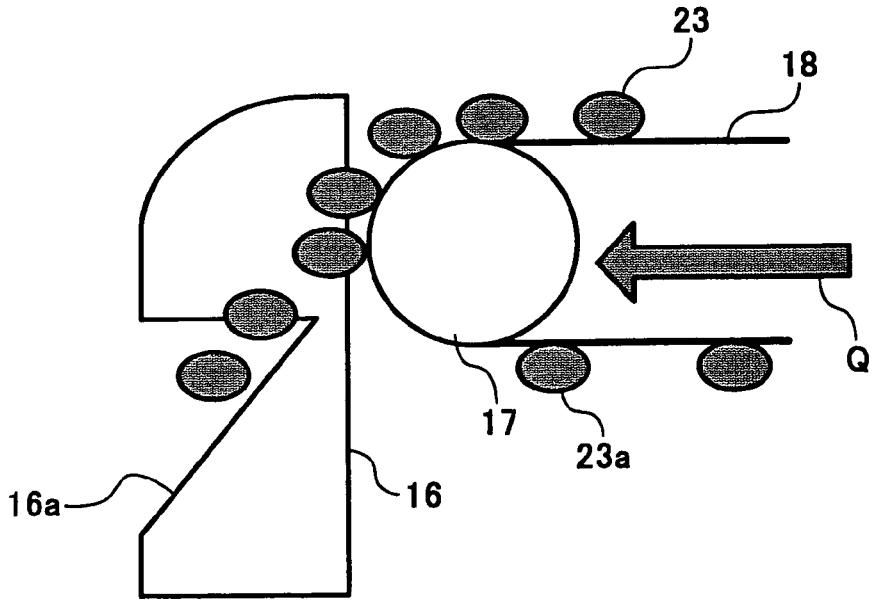
FIG. 23 shows a conventional condition wherein scraps are transferred from a belt to a scrap guide.

As shown in FIG. 23, it is likely that the scraps 23 conveyed by the belt 18 to the front side or operation side do not drop to the slope of the scrape guide 16, but remain on the belt 18 and again enter the finisher. This is ascribable to fibers appearing on the edges of the scraps 23 and electrostatically or otherwise adhered to the belt 18. Such scraps 23 again entered the finisher are apt to drop somewhere in the sheet finisher while being conveyed by the belt 18.

Figure 24:
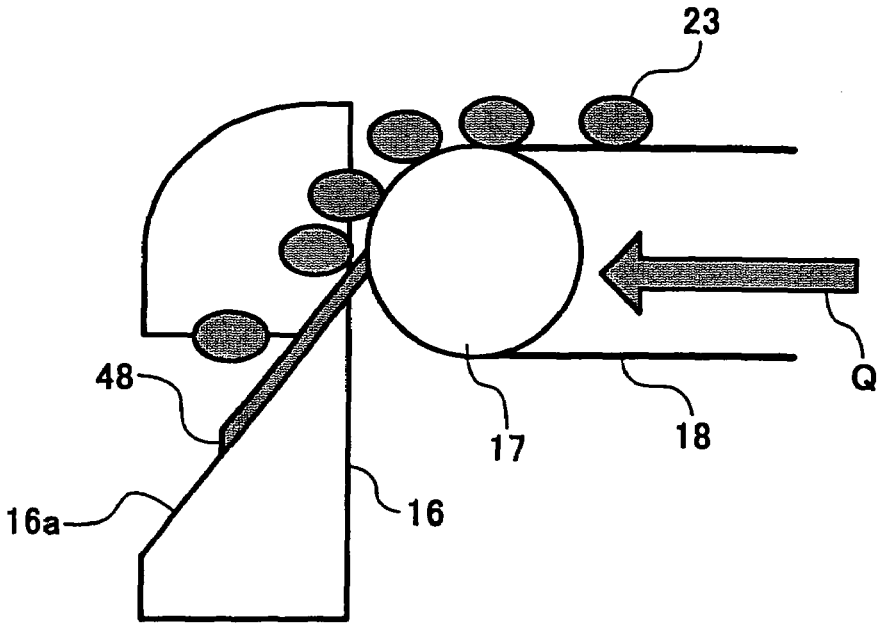
FIG. 24 is a view similar to FIG. 23, showing a condition wherein scraps are transferred from the belt to the scrap guide in the fourth embodiment.

In light of the above, as shown in FIG. 24, the illustrative embodiment further includes a blade 48 for separating the scraps 23 from the belt 18. The blade 48 is adhered to the guide surface 16*a* of the scrap guide 16 with its leading edge contacting the belt 18. In this configuration, the blade 48 forcibly removes the scraps 23 from the belt 18 and causes them to drop into the hopper 3 without returning to the inside of the sheet finisher.

As stated above, the illustrative embodiment has various unprecedented advantages, as enumerated below.

(1) The scraps are conveyed to the front side of the sheet finisher over the front side wall of the sheet finisher and can therefore be surely conveyed to the space outside of the front side wall.

(2) The scraps are surely conveyed to the above position without dropping in the sheet finisher or between opposite side walls. This allows the space beneath the punching means to be efficiently used for thereby reducing the size of the finisher.

(3) The scrap guide means guides the scraps from the scrap conveying means to the scrap storing means while dividing the scraps in at least two directions. The scraps therefore do not pile in the scrap storing means via a single position, so that the space available in the scrap storing means is efficiently used.

(4) The scrap guide means includes the screen plate configured to allow the scraps to drop from the scrap guide means into the scrap storing means in interlocked relation to the front cover only when the front cover is closed. This prevents the scraps from being scattered around when the front cover is opened.

(5) The removing means forcibly removes the scraps from the scrap conveying means and causes them to drop into the scrap storing means. The scraps can therefore be surely introduced into the scrap storing means without again entering the sheet finisher.

Fifth Embodiment

FIGS. 1-18 and the description of the first embodiment made with reference thereto also apply to a fifth embodiment of the present invention. The following description will therefore concentrate only on differences between the first embodiment and the fifth embodiment.

Figure 25:
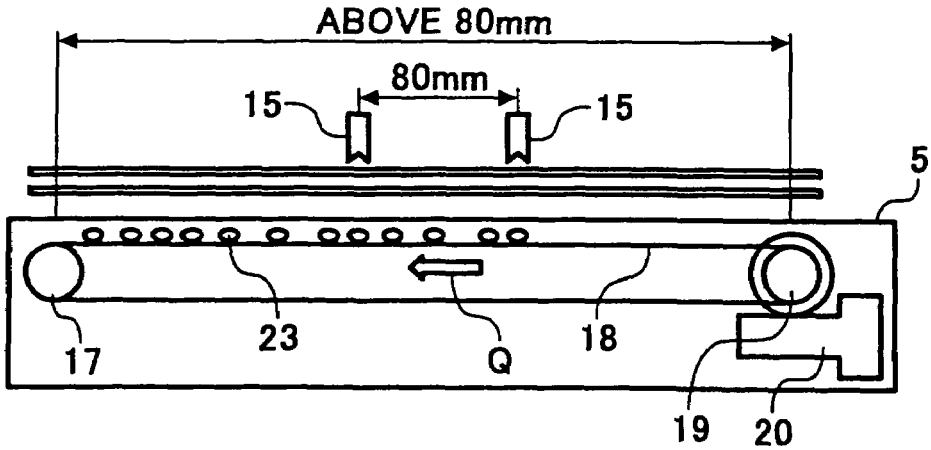
FIG. 25 shows a relation between a distance between punches particular to a two-punch system and a distance of conveyance specifically in accordance with a fifth embodiment of the present invention.
Figure 26:
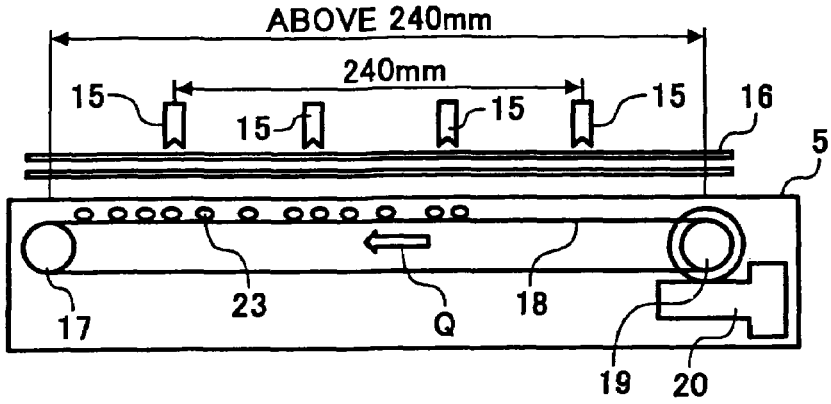
FIG. 26 is a view similar to FIG. 25, showing the above relation particular to a four-punch system.

FIGS. 25 and 26 respectively show specific dimensions of a two-hole punching unit and those of a four-hole punching unit particular to the illustrative embodiment. In the two-hole punching unit of FIG. 25, which is standardized in Japan, the distance between the punches 15 is 80 mm. The scraps 23 produced by the punches 15 drop on and are conveyed by the belt 18. In the illustrative embodiment, the distance over which the belt 18 conveys the scraps 23 is selected to be greater than 80 mm. Also, the scraps 23 drop on the belt 18 without fail because the belt 18 is necessarily present below the punches 15.

In the four-hole punching unit of FIG. 26, which is standardized in Europe, the distance between the outermost punches 15 is 240 mm. In this case, the belt 18 is provided with a length greater than 240 mm.

Figure 27:
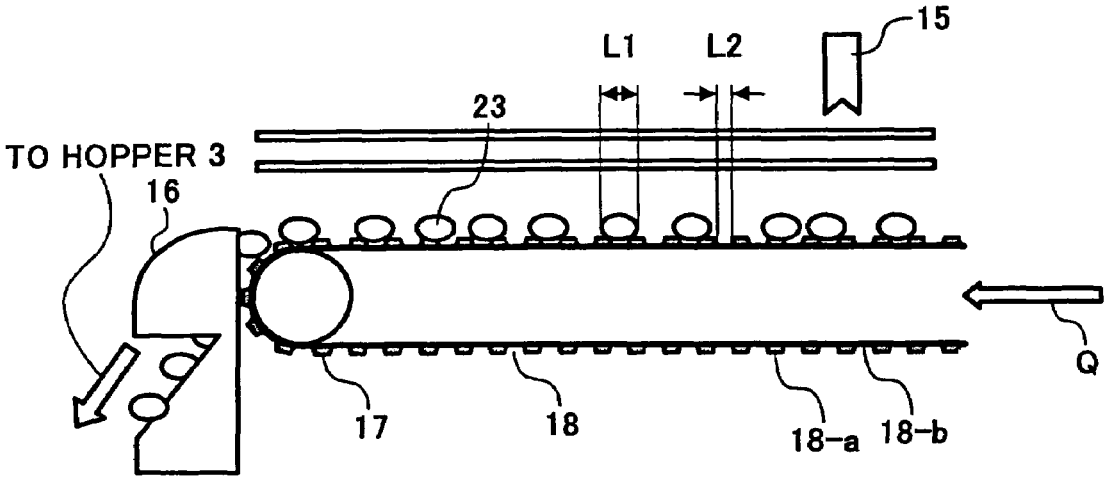
FIG. 27 shows a specific configuration of the belt.

FIG. 27 shows the configuration of the belt 18 unique to the illustrative embodiment. As shown, the belt 18 is provided with an irregular outer surface for promoting the parting of the scraps 23. Recesses forming part of the irregular surface each have a width L2 smaller than the maximum diameter L1 of the scraps 23, preventing the scraps from being fully buried in the recesses. With this configuration, the belt 18 conveys the scraps 23 while preventing them from closely adhering to the belt 18 and therefore causes the scraps 23 to surely drop into the hopper 3. In FIG. 27, the recesses and projections are labeled 18-*b* and 18-*a*, respectively.

Figure 28:
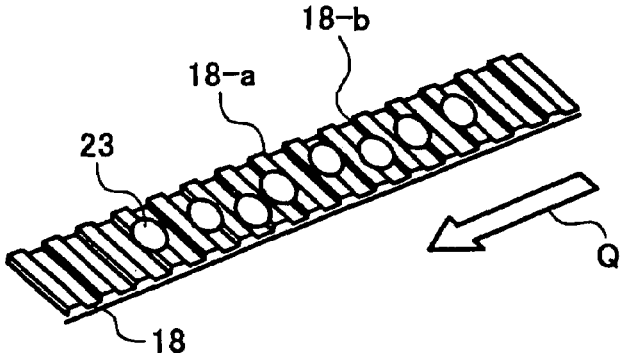
FIG. 28 shows another specific configuration of the belt.

FIG. 28 shows a modification of the illustrative embodiment. In the modification, the belt 18 is implemented as a low-cost timing belt formed with projections and recesses, or teeth, each extending in the direction perpendicular to the direction Q. This is preferable in the aspect of parting of the scraps 23.

The timing belt applied to the belt 18 may be one whose opposite surfaces are toothed or one toothed on only one surface and turned inside out. The timing belt toothed on both surfaces is expensive and thick and therefore undesirable from the space standpoint. While the timing belt toothed on one side is free from such a problem, it should be driven at speed low enough to obviate slip because the flat surface of the belt is be passed over the timing pulleys 17 and 19.

As stated above, in the illustrative embodiment, the distance over which the scrap conveying means conveys the scraps is greater than the distance between the punching means, so that the scraps can be surely conveyed by the conveying means. Further, the surface of the conveying means is so configured as to contact the scraps over a minimum of area, thereby reducing electrostatic adhesion to act between the belt and the scraps. This allows the scraps to surely part from the conveying means at an adequate position and fall in the hopper.

Sixth Embodiment

FIGS. 1 through 18 and the first embodiment described with reference made thereto also apply to a sixth embodiment to be described hereinafter. The following description will therefore concentrate on differences between the first embodiment and the sixth embodiment.

Figure 29:
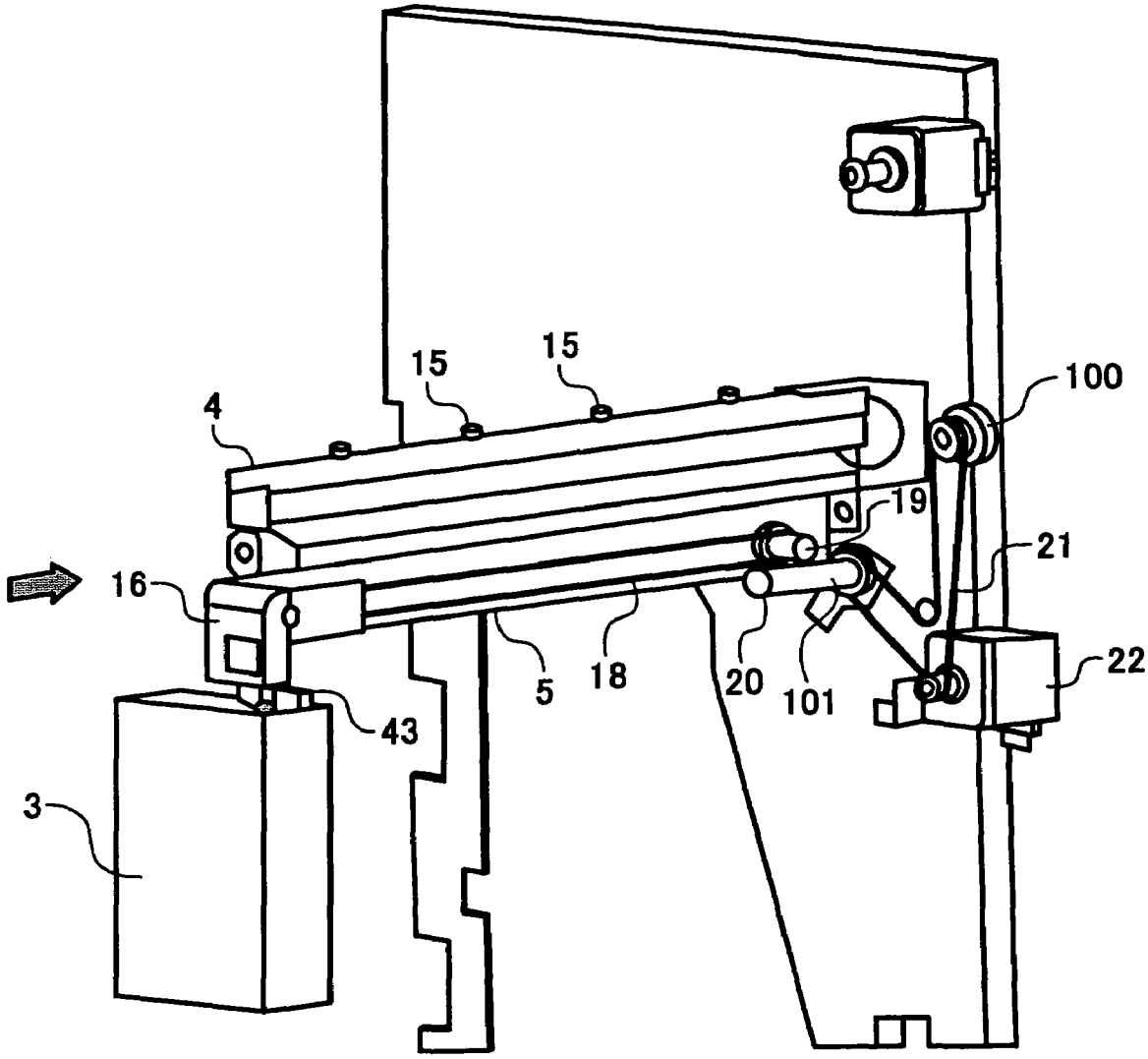
FIGS. 29 through 31 show a relation between a punching unit and a scrap conveying unit representative of a sixth embodiment of the present invention.
Figure 30:
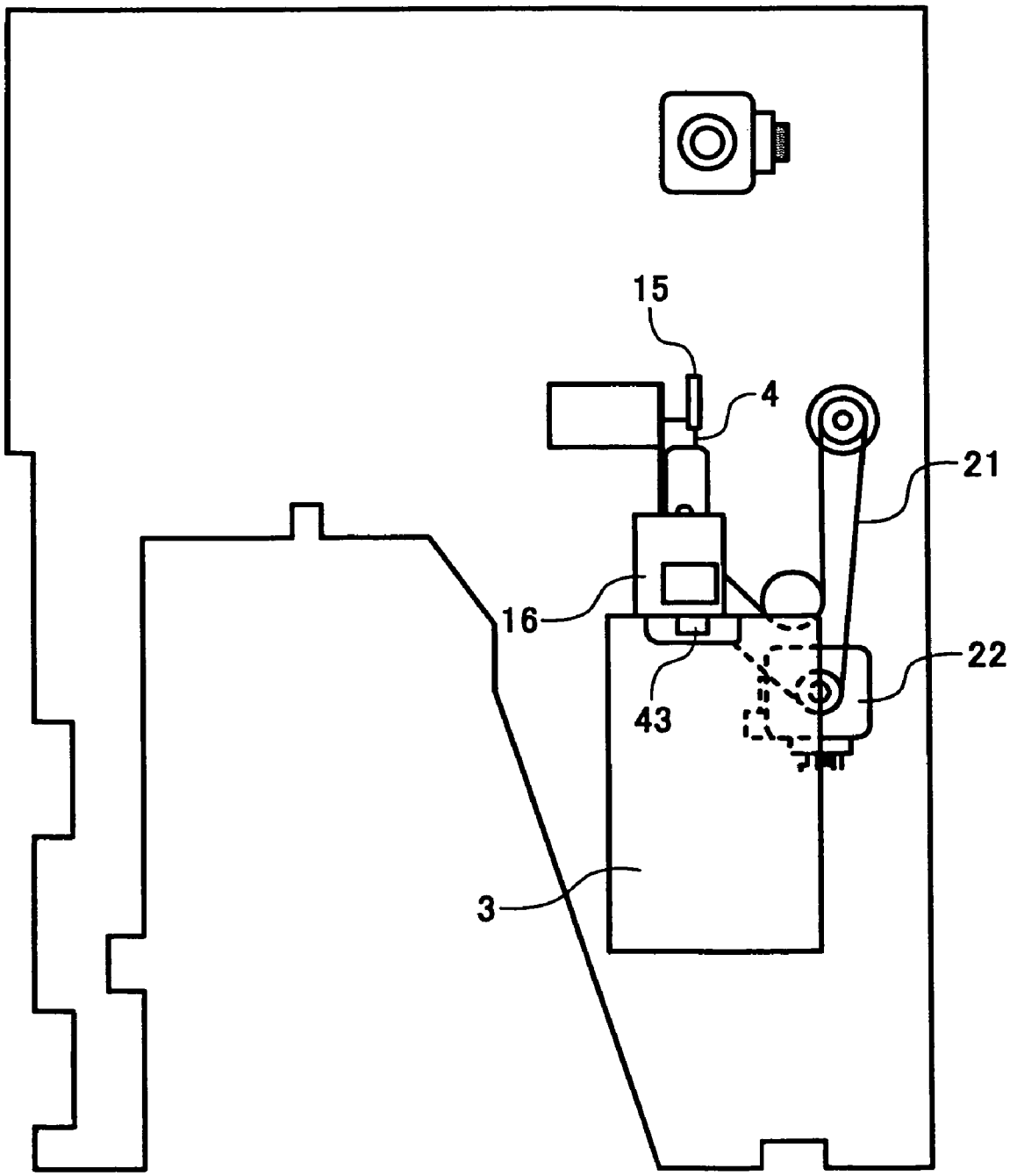
Figure 31:
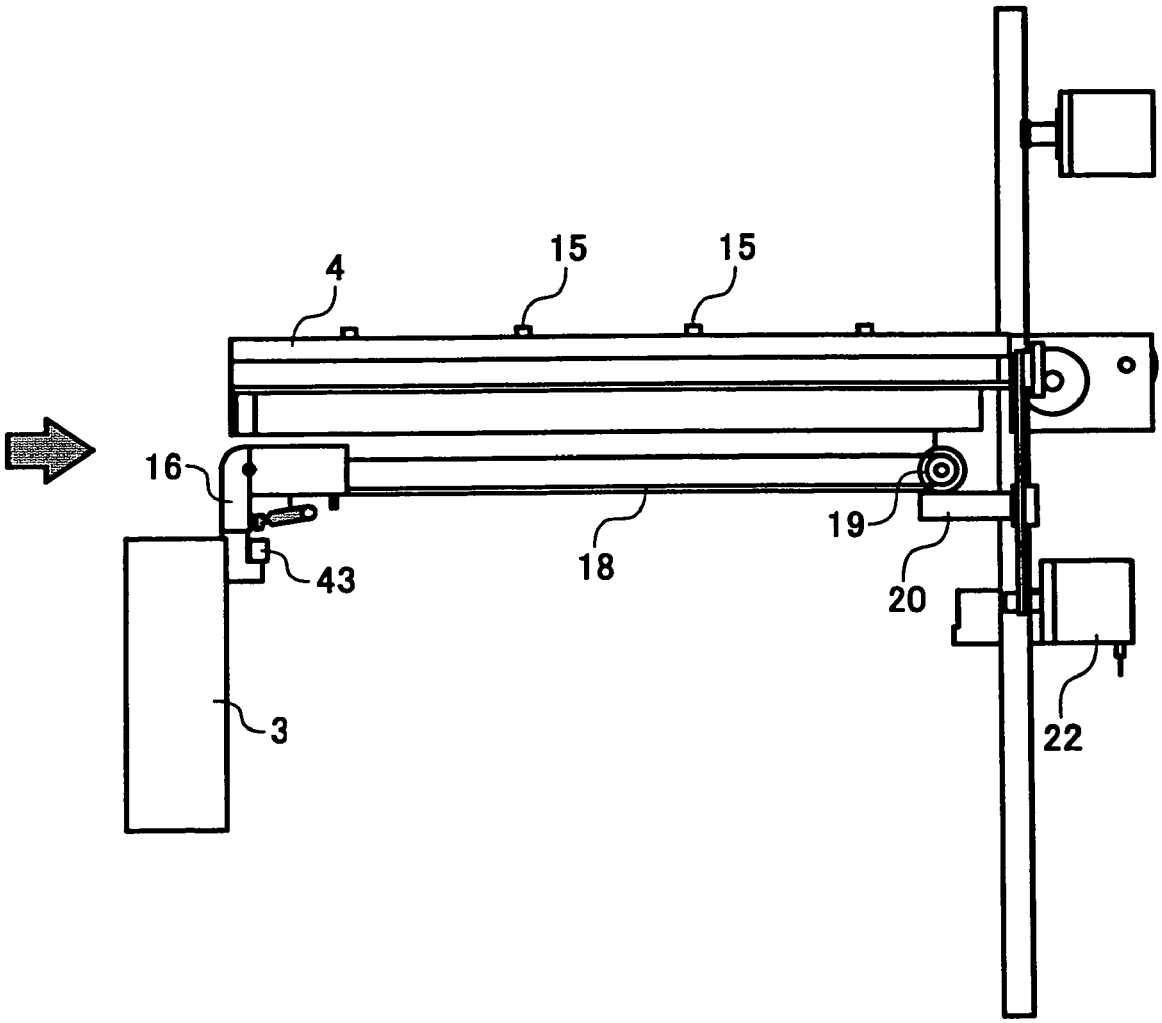

FIG. 29 shows a relation between the punching unit 4 and the scrap conveying unit 5 particular to the illustrative embodiment. FIGS. 30 and 31 show the same relation in a fragmentary front view and a plan view, respectively. As shown, the scrap conveying unit 5 beneath the punching unit 4 is configured to be inserted into the sheet finisher from the front side or operation side, as indicated by an arrow. The conveying unit 5 conveys the scraps 23 in the direction Q toward the hopper 3. The worm 20 drives the belt 18 via the timing pulley 19, as stated earlier.

More specifically, as shown in FIG. 29, the worm 20 and timing pulley 19 are held in mesh with each other while the belt 18 is passed over the timing pulley 19. In this condition, the conveying unit 5 is constructed into a unit that can be inserted into the sheet finisher from the front. The conveying unit 5 therefore does not include drive means for driving the belt 18 alone. The absence of the drive mans successfully reduces the weight of the conveying unit 4 for thereby facilitating mounting of the conveying unit 4.

The worm 20 is formed with a spur gear portion at its base portion. When the spur gear portion is brought into mesh with a gear 101, the belt 18 can be driven. The timing belt 21 is passed over the pulley portion of the gear 101 and driven by the stepping motor 22. At the same time, a pulley 100 engaged with the inlet roller pair 1, FIG. 1, is driven by the stepping motor 22, causing the inlet roller pair 1 to rotate. In this manner, the stepping motor 22 assigned to the inlet roller pair 1 is used to drive the belt 18 as well.

Figure 32:
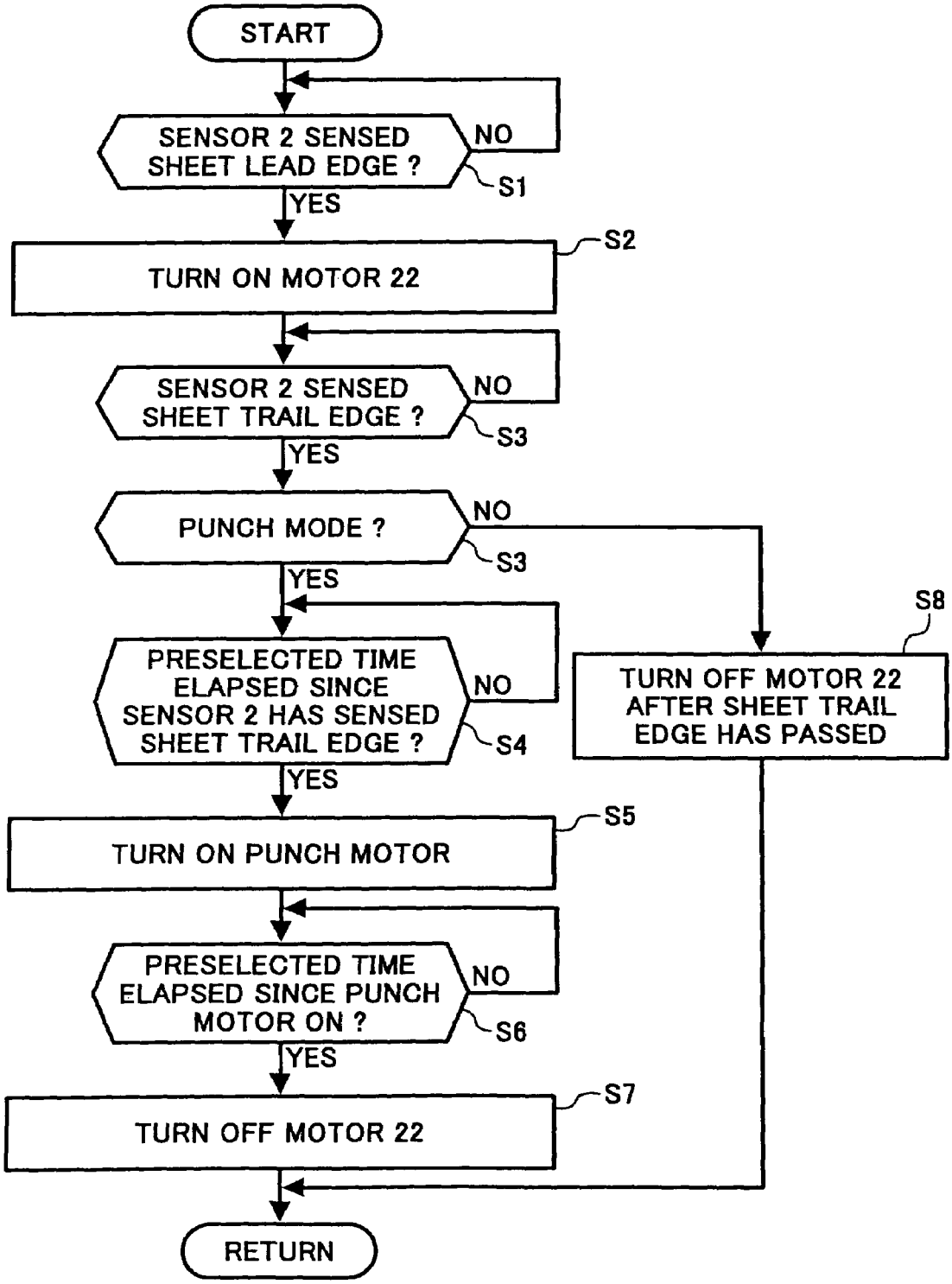
FIG. 32 is a flowchart demonstrating a specific operation of the belt driven by a stepping motor and dealing with the last sheet of a single job.

Reference will be made to FIG. 32 for describing the drive of the belt 18 effected by the stepping motor 22. It is to be noted that the procedure of FIG. 32 deals with the last sheet of a single job. As shown, the stepping motor 22 starts rotating when the inlet sensor 2 senses the last sheet of a job entered the sheet finisher (steps S1 and S2). The stepping motor 22 drives the inlet roller pair 1 and belt 18 via the timing belt 21. On the elapse of a preselected period of time since the trailing edge of the sheet has away from the inlet sensor 2 (YES, step S3), the punching unit 4 punches the sheet (steps S4, S5 and S6). The stepping motor 22 continuously operates until the scraps 23 dropped from the sheet on the belt 18 have been collected in the hopper 3 (step S7). The stepping motor 22 stops operating as soon as the scraps 23 all drop from the belt 18 into the hopper 3 (step S8).

If the sheet does not have to be punched (NO, step S3), then the stepping motor 22 stops operating just after the sheet has moved away from the inlet roller pair 1, thereby saving power.

As stated above, in the illustrative embodiment, a single drive source drives both of the scrap conveying means and sheet conveying means, i.e., an exclusive motor for the scrap conveying means is not necessary. The scrap conveying means is therefore reduced in cost and weight and therefore easy to mount to the sheet finisher.

Further, the belt is continuously driven until the scraps dropped on the belt all have been collected in the hopper. The scraps can therefore be surely conveyed without regard to the image forming operation. This prevents the scraps from dropping or being scattered around inside the sheet finisher.

Seventh Embodiment

FIGS. 1 through 18 and the first embodiment described with reference made thereto also apply to a seventh embodiment to be described hereinafter. The following description will therefore concentrate on differences between the first embodiment and the seventh embodiment.

Figure 33A:
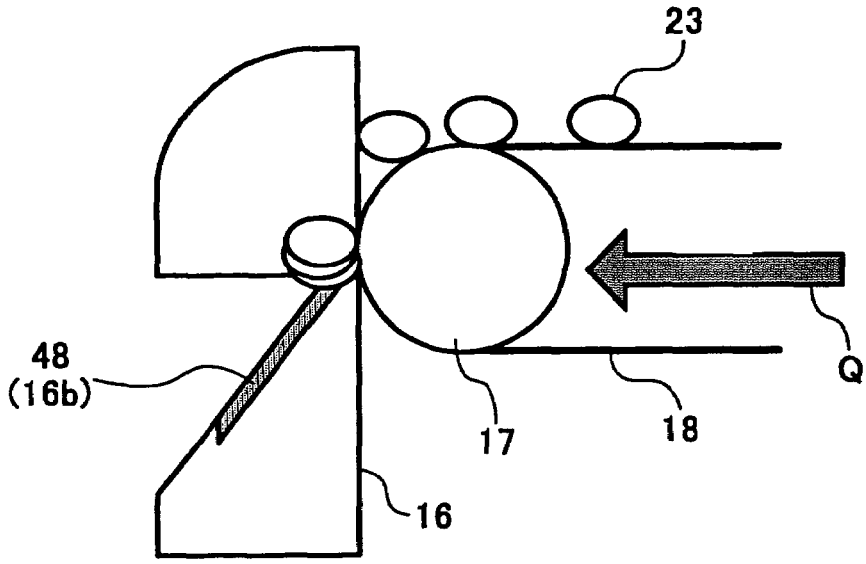
FIGS. 33A and 33B demonstrate how a seventh embodiment of the present invention removes scraps from the belt.
Figure 33B:
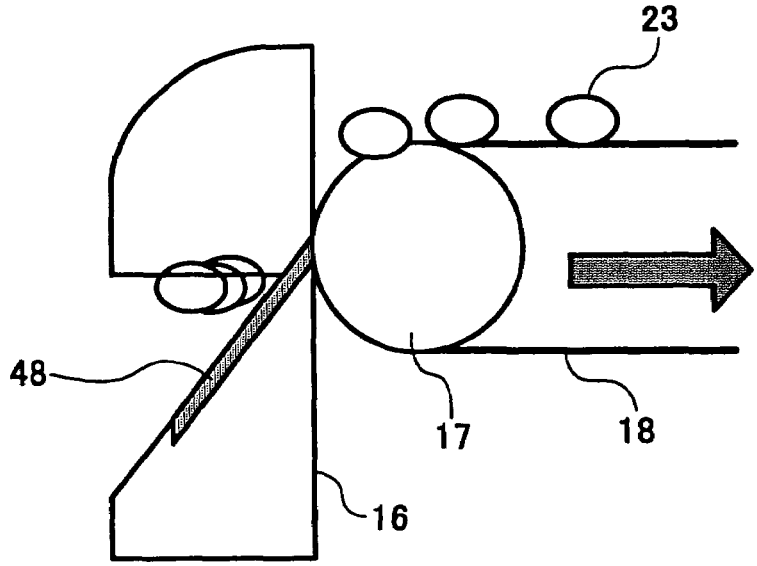

As shown in FIGS. 33A and 33B, the blade 48 is positioned in the upper portion of the slope guide 16*b*, which forms part of the scrap guide 16. The upper edge of the blade 48 adjoins the end of the belt 18 facing the scrap guide 16 and causes the scraps 23 reached it into the hopper 3. The belt 18 conveys the scraps 23 toward the scrap guide 16 over the front side wall 45 of the sheet finisher, as stated earlier. However, the configuration of FIGS. 5 and 6 has the following problem left unsolved. Fibers are apt to appear on the edges of the scraps 23 produced from the sheet. This, coupled with the upper edge of the blade 48 adjoining the belt 18, is likely to cause the belt 18 and blade 48 to catch the fibers of the scraps 23 therebeteween, causing the following scraps 23 to stop at the upper edge of the blade 48.

To solve the above problem, as shown in FIG. 33B, the illustrative embodiment inversely drives the belt 18, i.e., moves it in the direction opposite to the direction of scrap conveyance, thereby moving the scraps 23 on the belt 18 backward by a suitable distance. Consequently, the scrap 23 caught between the belt 18 and the blade 48 is released and surely dropped into the hopper 3, which is positioned between the front side wall 45 and the front cover 14. This can be done with specific means to be described hereinafter.

Figure 34:
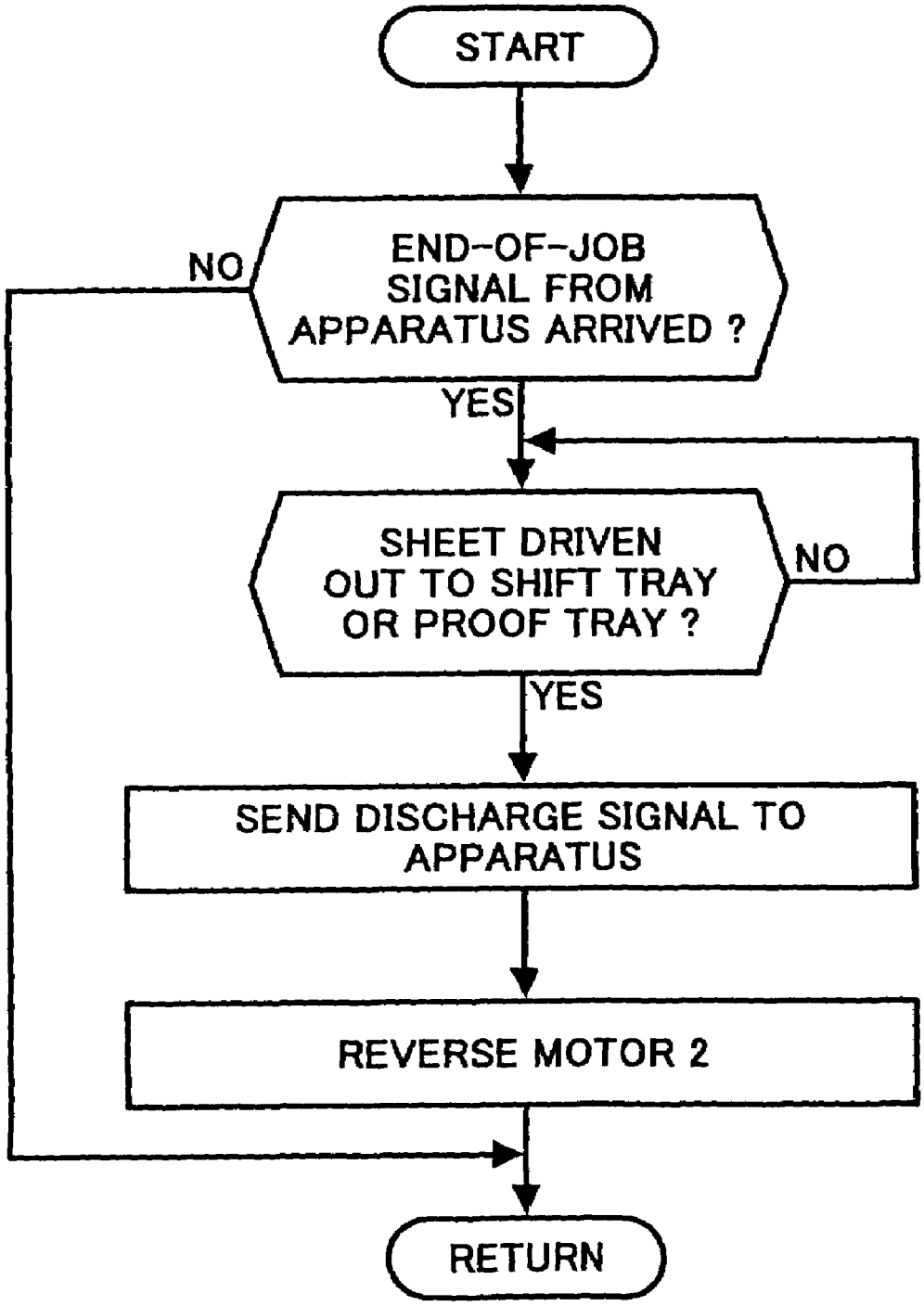
FIGS. 34 and 35 are flowcharts each demonstrating a particular procedure available with the seventh embodiment.

In the sheet finisher FR of the illustrative embodiment, when a sheet is driven out to the shift tray 9 or the proof tray 29, a stop signal is sent to the image forming apparatus PR. In response, the stepping motor 22 is caused to move in the reverse direction over a preselected period of time and then move in the usual direction for scrap conveyance. As a result, the scrap 23 caught between the belt 18 and the blade 48 successfully drops into the hopper 3. Such a specific procedure is shown in FIG. 34.

Figure 35:
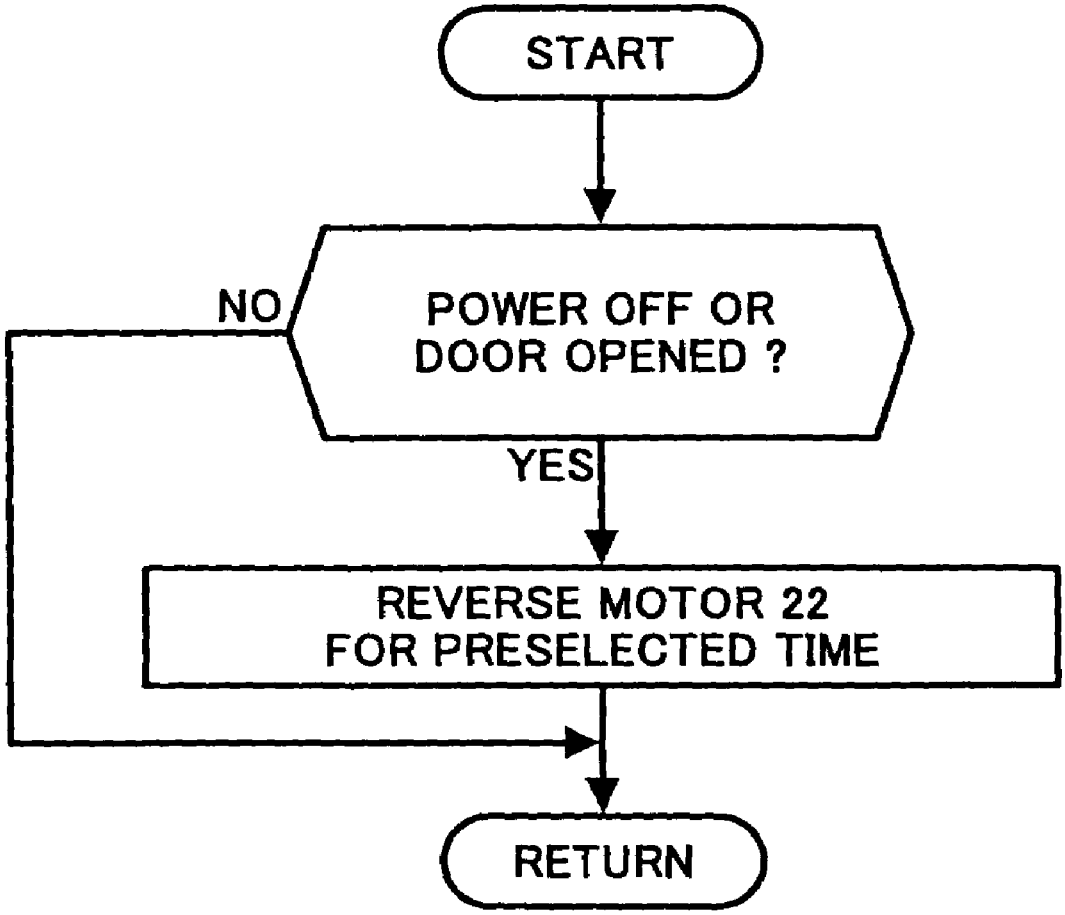

Another specific procedure is shown in FIG. 35. As shown, when the power switch of the image forming apparatus PR is turned on or when the front cover 14 is opened, the stepping motor 22 is driven for a preselected period of time in the direction opposite to the direction for scrap conveyance. As a result, the scraps caught on the belt 18 are surely caused to drop into the hopper 3 positioned between the front side wall 45 and the front cover 14. The scraps can therefore be removed even when the power switch of the apparatus PR is turned off or when a sheet jam occurs.

Figure 36:
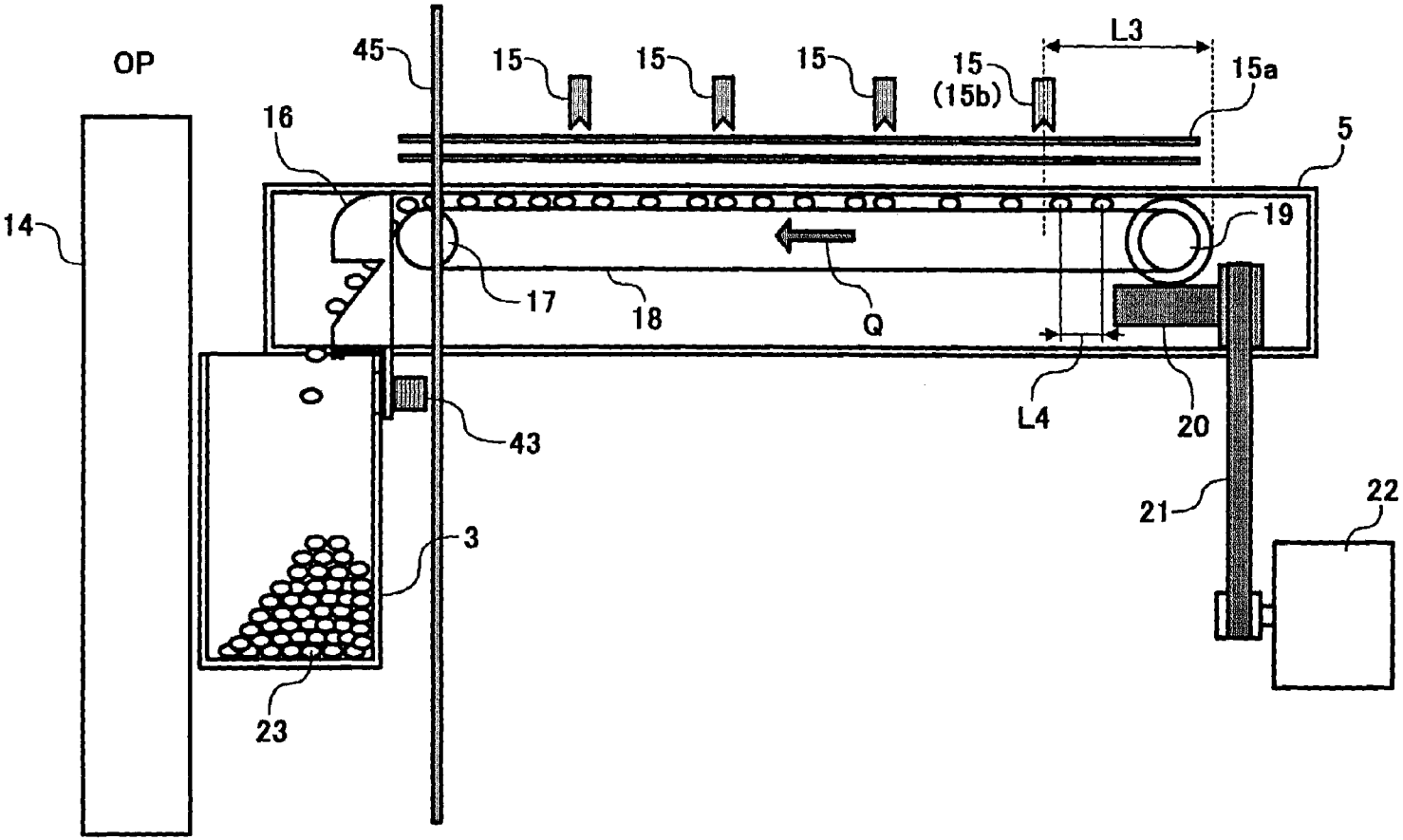
FIG. 36 is a view showing the configuration of the seventh embodiment more specifically.

As for the distance of reverse movement of the belt 18, as shown in FIG. 36, assume that the distance between the end of the belt 18 passed over the timing pulley 19 and the punch 15*b* closest to it is L3. Then, in the illustrative embodiment, the belt 18 is moved in the reverse direction by a minimum necessary distance L4 shorter than the distance L3 and necessary for the fibers of the scraps to be separated from the blade 48. This allows the scraps 23 to surely drop on the inclined surface of the blade 48 and prevents the scraps on the belt 18 from dropping to the side opposite to the hopper 3 when the power switch is turned on or the front cover 14 is opened.

Figure 37A:
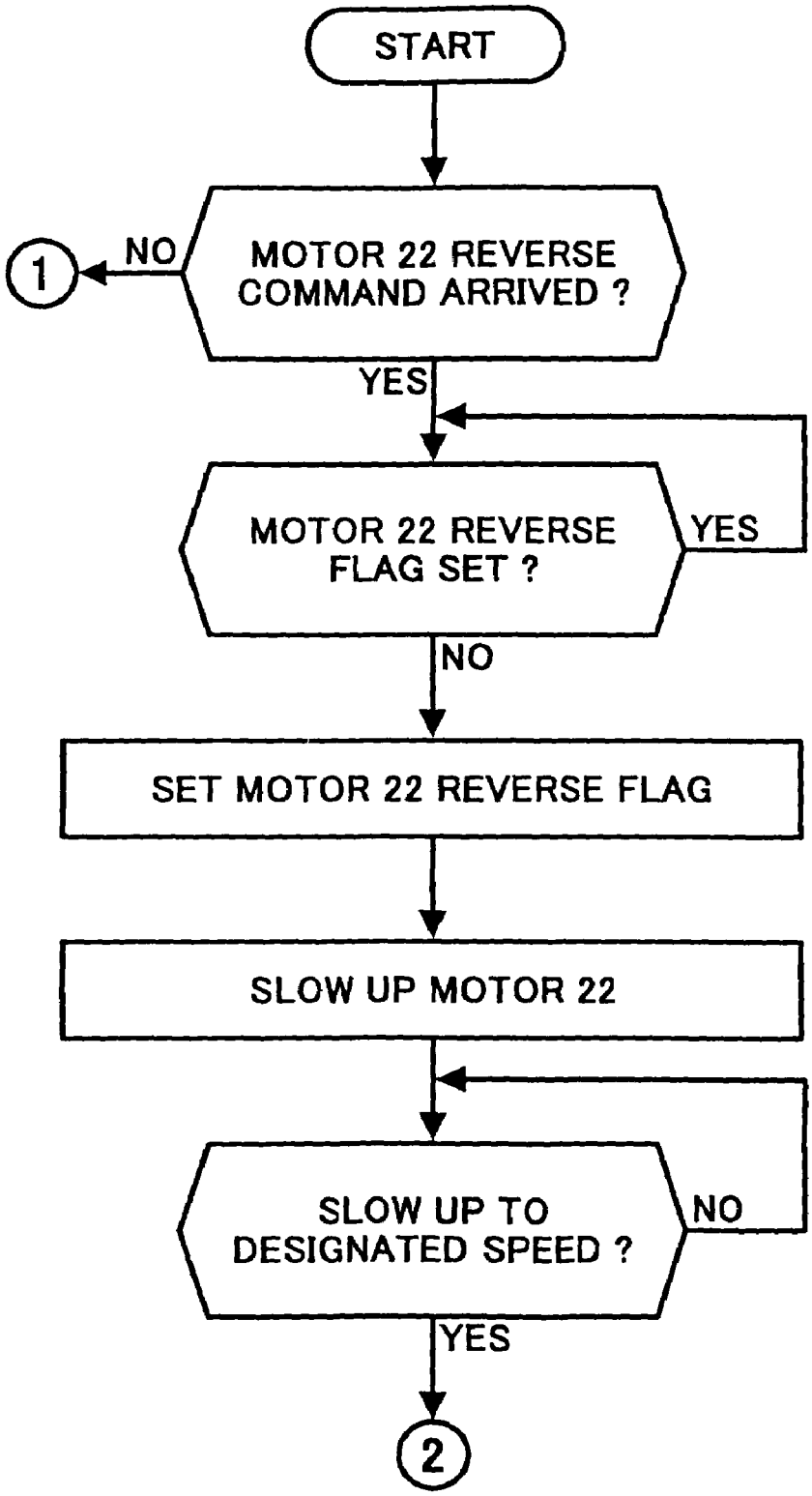
FIGS. 37A and 37B are flowcharts demonstrating a specific operation of the seventh embodiment.
Figure 37B:
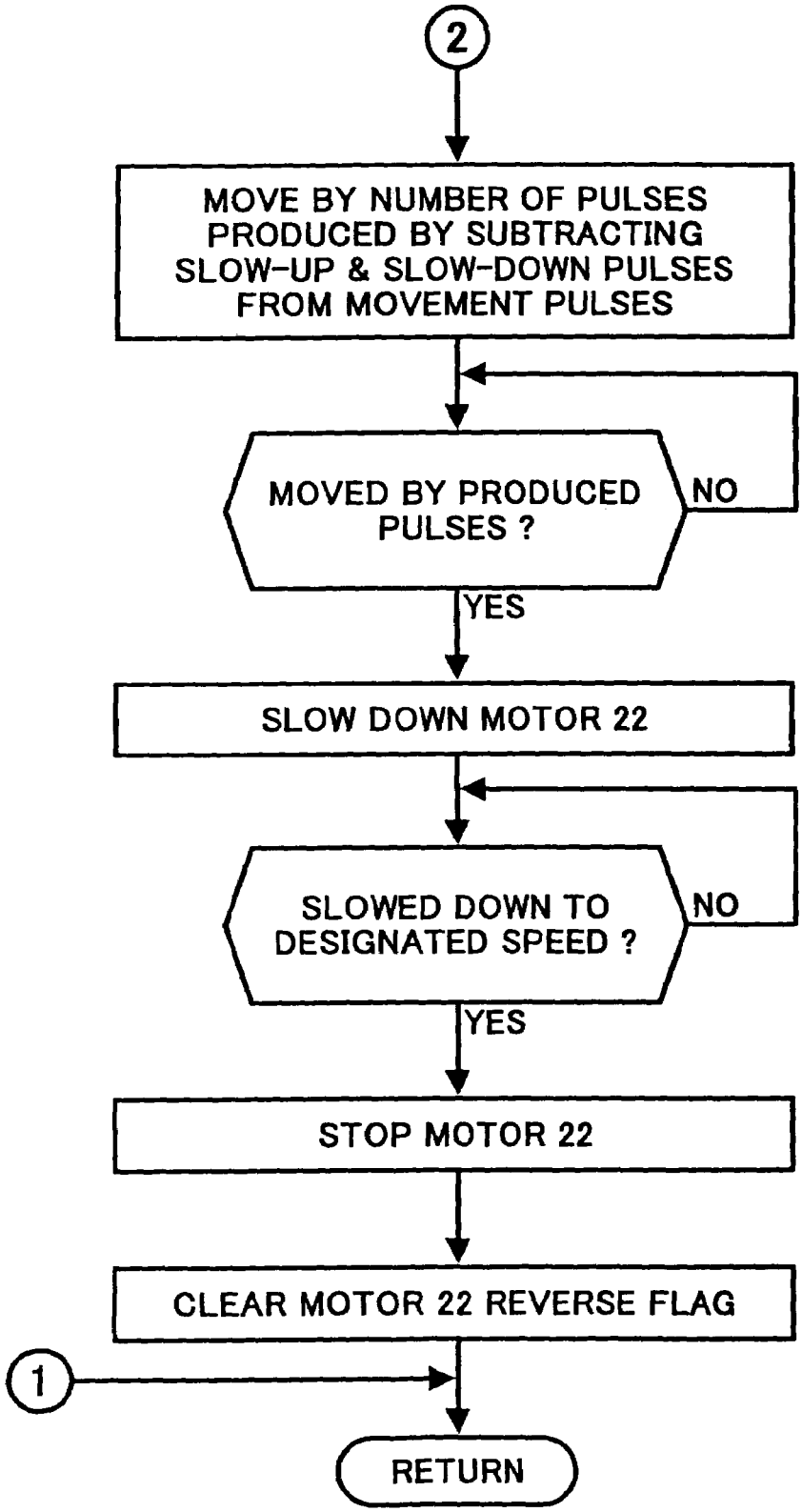

To move the belt 18 by the distance L4 in the reverse direction, a number of pulses corresponding to the distance L4 should only be input to the stepping motor 22, as shown in FIGS. 37A and 37B.

Figure 38:
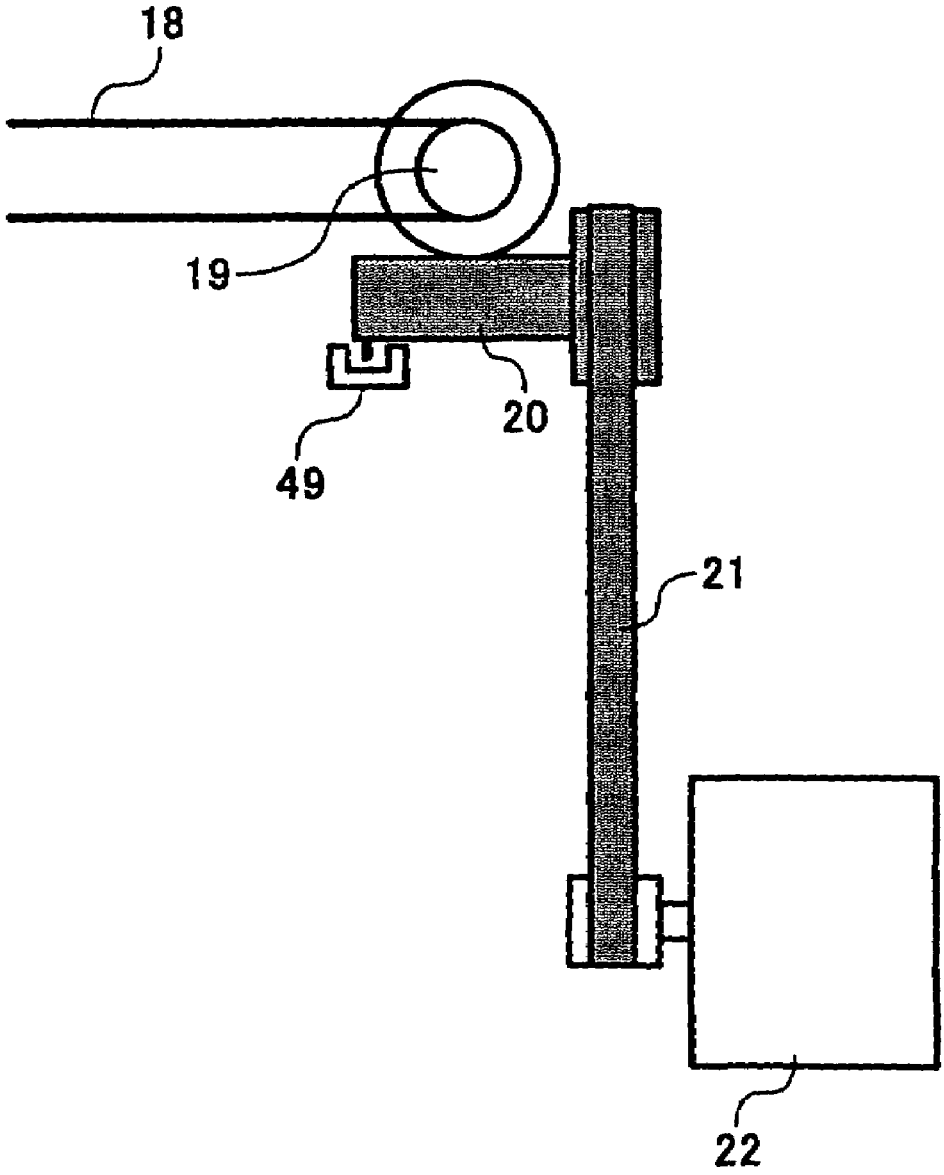
FIG. 38 is a fragmentary view showing a mechanism included in the seventh embodiment for moving the belt in the reverse direction.
Figure 39:
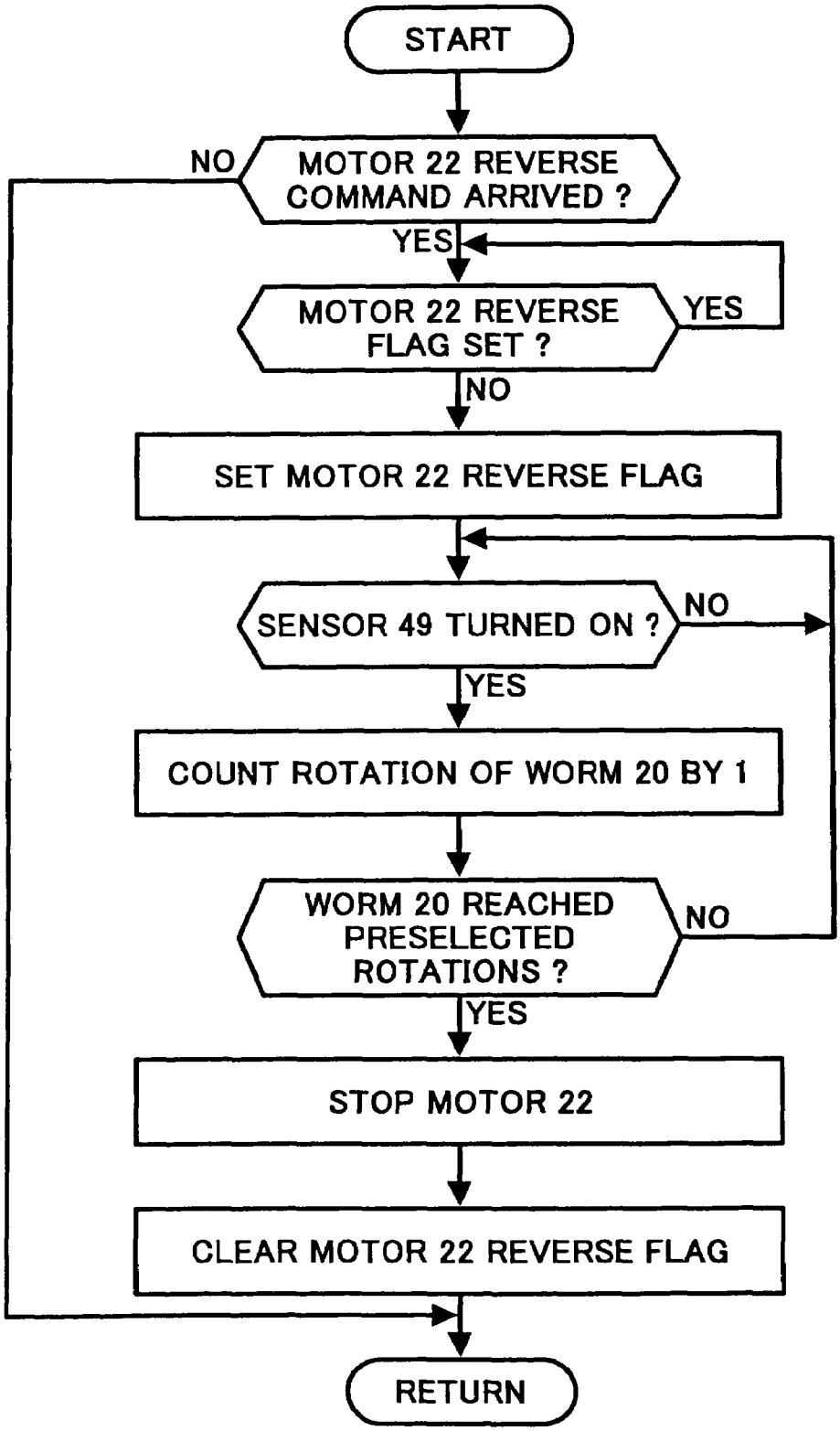
FIG. 39 is a flowchart demonstrating a specific operation of the seventh embodiment.

As shown in FIG. 38, the belt 18 may be moved to any desired position in the reverse direction on the basis of the output of a sensor 49 responsive to the current position of the worm 20. FIG. 39 demonstrates a procedure for practicing this scheme.

In summary, the illustrative embodiment has various advantages, as enumerated below.

(1) The scrap conveying means is moved in the reverse direction to convey the scraps by a preselected distance in the direction opposite to the direction in which the conveying means conveys them toward the guide means. Therefore, even when the fibers of the scraps are caught between the guide means and the conveying means, such scraps can be surely released and smoothly introduced into the scrap storing means.

(2) The scrap conveying means is implemented as an endless belt, so that the scraps with the fibers can be removed by a simple operation.

(3) Even when the scraps are not removed due to the turn-off of the power switch or a sheet jam, they can be surely removed later.

(4) The scrap storing means is positioned at the front side or operation side of the sheet finisher and is therefore easy to handle.

(5) The scrap storing means is mounted on the inner surface of the openable door and therefore saves size and space and is easy to operate. In addition, the scrap storing means is removable from the above door.

(6) The relation of Db<Da is established to prevent the scraps from dropping from the most upstream portion of the scrap conveying means when the power switch of the image forming apparatus is turned on or when the door is opened. More specifically, the scrap conveying means is not moved in the reverse direction more than necessary, so that the scraps do not drop to the side opposite to the scrap storing means. In addition, the minimum necessary movement is successful to save power.

Various modifications will become possible for those skilled in the art after receiving the teachings of the present disclosure without departing from the scope thereof.

What is claimed is:

1. A sheet finisher for use in an image forming apparatus including a front cover, the sheet finisher comprising:

a punching unit including a plurality of punches of a predetermined diameter and configured to punch a sheet to produce scraps; and a scrap conveying unit configured to convey the scraps produced from the sheet by said punching unit along a direction which is substantially perpendicular to a direction of the sheet conveyance; and wherein the scrap conveying unit comprises a stripe-like conveying body whose first surface on which the scraps are conveyed is formed with projections, and whose opposite second surface does not include projections, and a distance between the projections is smaller than the predetermined diameter of the punches.

2. The sheet finisher of claim 1, wherein said scrap conveying unit comprises a belt.

3. The sheet finisher of claim 1, further comprising a drive unit for driving said scrap conveying unit.

4. The sheet finisher of claim 1, further comprising a guide unit for guiding the conveyed scraps to the scrap receptacle.

5. An image forming apparatus comprising:

a front cover;

an image forming unit configured to form an image on a sheet;

a punching unit including a plurality of punches of a predetermined diameter and configured to punch the sheet to produce scraps;

a scrap conveying unit configured to convey the scraps produced from the sheet by said punching unit along a direction which is substantially perpendicular to a direction of the sheet conveyance, wherein the scrap conveying unit comprises a stripe-like conveying body whose first surface on which the scraps are conveyed is formed with projections, and whose opposite second surface does not include projections, and a distance between the projections is smaller than the predetermined diameter of the punches; and a processor configured to control the operation of said scrap conveying unit.

6. The image forming apparatus of claim 5, wherein said scrap conveying unit comprises a belt.

7. An image forming apparatus comprising:

a front cover;

an image forming unit configured to form an image on a sheet;

a processor configured to control a punching unit of a predetermined diameter configured to punch the sheet to produce scraps; and a scrap conveying unit configured to convey the scraps produced from the sheet by the punching unit along a direction which is substantially perpendicular to a direction of the sheet conveyance; and wherein the scrap conveying unit comprises a stripe-like conveying body whose first surface on which the scraps are conveyed is formed with projections, and whose opposite second surface does not include projections, and a distance between the projections is smaller than the predetermined diameter of the punches.

8. The image forming apparatus of claim 7, further comprising:

a finisher including the punching unit and the scrap conveying unit, wherein said processor is provided in said finisher.

9. The image forming apparatus of claim 8, wherein said scrap conveying unit comprises a belt.

10. The image forming apparatus of claim 7, wherein said scrap conveying unit comprises a belt.

* * * * *